US008974150B2

(12) United States Patent
Salisbury et al.

(10) Patent No.: US 8,974,150 B2
(45) Date of Patent: Mar. 10, 2015

(54) MICROPILE FOUNDATION MATRIX

(75) Inventors: Nickolas G. Salisbury, Coeur d'Alene, ID (US); Scott R. Tunison, Liberty Lake, WA (US); Freeman A. Thompson, Liberty Lake, WA (US)

(73) Assignee: Crux Subsurface, Inc., Spokane Valley, WA (US)

( * ) Notice: Subject to any disclaimer, the term of this patent is extended or adjusted under 35 U.S.C. 154(b) by 798 days.

(21) Appl. No.: 12/797,945

(22) Filed: Jun. 10, 2010

(65) Prior Publication Data

US 2011/0044766 A1 Feb. 24, 2011

Related U.S. Application Data

(60) Provisional application No. 61/234,930, filed on Aug. 18, 2009.

(51) Int. Cl.
*E02D 5/28* (2006.01)
*E02D 5/72* (2006.01)
(Continued)

(52) U.S. Cl.
CPC ..... *E21B 15/04* (2013.01); *E21B 15/003* (2013.01)
USPC ..... 405/232; 405/231; 405/233; 405/244; 405/255

(58) Field of Classification Search
CPC ..... E02D 5/22; E02D 11/00; E02D 7/02; E02D 5/285; E02D 13/00; E02D 27/42; E02D 5/56; E02D 7/00; E02D 5/54; E02D 7/18; E02D 7/22; E02D 5/24; E02D 27/12; E02D 7/06; E02D 27/50; E02D 5/28; E02D 5/48; E02D 5/50; E02D 5/60
USPC ..... 405/231, 232, 233, 244, 255; 175/19, 175/22, 50, 171
See application file for complete search history.

(56) References Cited

U.S. PATENT DOCUMENTS 1,486,594 A 3/1924 Malone
2,843,347 A 7/1958 King
(Continued)

FOREIGN PATENT DOCUMENTS

JP 2003074056 A * 3/2003 ..... E02D 7/22
JP 2003074057 A * 3/2003 ..... E02D 7/22
(Continued)

OTHER PUBLICATIONS

ITCO Allied Engineering Co Types of Borings Oct. 5, 2008 (The Wayback Machine) URL: http://www.itcoallied.com/id10.html.*
(Continued)

*Primary Examiner* — Benjamin Fiorello
*Assistant Examiner* — Edwin Toledo-Duran
(74) *Attorney, Agent, or Firm* — Lee & Hayes, PLLC

(57) ABSTRACT

The disclosure describes, in part, apparatuses and methods for installing structures (e.g., foundations, footings, anchors, abutments, etc.) at work sites, such as difficult-access work sites. In some instances, a rotating drill assembly is assembled over a target location in order to excavate a radial array of batter-angled shafts associated with the target location in preparation for the installation of a radial array of micropiles. An operator utilizes the rotating drill in combination with a foundation pile schedule/decision matrix to design and install the radial array of batter-angled micropiles. This disclosure also describes techniques for designing, fabricating and installing structural caps to be coupled to the installed radial array batter angled micropiles. These structural caps are lightweight and, thus, more portable to difficult-access sites where they are coupled to the micropiles forming a foundation for structure to be installed at the difficult-access site.

29 Claims, 19 Drawing Sheets

(51) Int. Cl.

| | |
|---|---|
| ***E02D 7/18*** | (2006.01) |
| ***E02D 7/20*** | (2006.01) |
| ***E02D 5/36*** | (2006.01) |
| ***E02D 5/38*** | (2006.01) |
| ***E21B 15/04*** | (2006.01) |
| ***E21B 15/00*** | (2006.01) |

(56) References Cited

U.S. PATENT DOCUMENTS

| | | | | |
|---|---|---|---|---|
| 2,916,233 | A | 12/1959 | Ecker | |
| 3,328,969 | A | 7/1967 | Murphy et al. | |
| 3,397,494 | A | 4/1968 | Waring | |
| 3,427,871 | A * | 2/1969 | Fox et al. | 73/84 |
| 3,590,930 | A | 7/1971 | Gronfors | |
| 3,789,921 | A | 2/1974 | DeChassy et al. | |
| 3,894,588 | A * | 7/1975 | Brill | 175/19 |
| 3,946,570 | A | 3/1976 | Freydier | |
| 3,946,601 | A * | 3/1976 | Yizhaki | 73/84 |
| 3,992,831 | A | 11/1976 | Bukovitz et al. | |
| 4,023,325 | A | 5/1977 | Paverman | |
| 4,043,133 | A * | 8/1977 | Yegge | 405/239 |
| 4,068,445 | A | 1/1978 | Bobbitt | |
| 4,099,354 | A | 7/1978 | DePirro | |
| 4,257,722 | A * | 3/1981 | Nakajima | 405/248 |
| 4,293,242 | A * | 10/1981 | Merjan | 405/239 |
| 4,339,899 | A | 7/1982 | Klenk et al. | |
| 4,606,155 | A | 8/1986 | Bukovitz et al. | |
| 4,640,118 | A * | 2/1987 | Kishida et al. | 73/9 |
| 4,687,380 | A | 8/1987 | Meek et al. | |
| 4,735,527 | A | 4/1988 | Bullivant | |
| 4,966,498 | A * | 10/1990 | Blum | 405/233 |
| 5,037,022 | A | 8/1991 | Rossi | |
| 5,039,256 | A | 8/1991 | Gagliano | |
| 5,060,435 | A | 10/1991 | Bogdanow | |
| 5,213,169 | A | 5/1993 | Heller | |
| 5,219,247 | A * | 6/1993 | Gemmi et al. | 405/241 |
| 5,226,488 | A | 7/1993 | Lessard et al. | |
| 5,256,004 | A * | 10/1993 | Gemmi et al. | 405/237 |
| 5,531,544 | A * | 7/1996 | Willcox, II | 405/231 |
| 5,577,857 | A * | 11/1996 | Miyasaka et al. | 403/316 |
| 5,749,198 | A | 5/1998 | Johnson | |
| 5,873,679 | A | 2/1999 | Cusimano | |
| 5,878,540 | A | 3/1999 | Morstein | |
| 5,908,268 | A * | 6/1999 | Yabuuchi | 405/233 |
| 5,931,604 | A * | 8/1999 | Queen et al. | 405/232 |
| 6,012,874 | A * | 1/2000 | Groneck et al. | 405/239 |
| 6,026,627 | A | 2/2000 | Moore | |
| 6,033,152 | A * | 3/2000 | Blum | 405/241 |
| 6,332,303 | B1 * | 12/2001 | Saito | 52/741.14 |
| 6,354,766 | B1 | 3/2002 | Fox | |
| 6,574,893 | B2 * | 6/2003 | Mizutani | 37/462 |
| 6,578,333 | B1 | 6/2003 | Gagliano | |
| 6,659,691 | B1 * | 12/2003 | Berry | 405/231 |
| 6,665,990 | B1 | 12/2003 | Cody et al. | |
| 6,799,401 | B1 | 10/2004 | Legler | |
| 6,801,814 | B1 * | 10/2004 | Wilson et al. | 700/90 |
| 6,854,934 | B2 * | 2/2005 | Yamane et al. | 405/255 |
| 6,877,710 | B2 | 4/2005 | Miyahara et al. | |
| 7,073,980 | B2 * | 7/2006 | Merjan et al. | 405/253 |
| 7,076,925 | B2 | 7/2006 | Gagliano | |
| 7,326,003 | B2 | 2/2008 | Gagliano | |
| 7,326,004 | B2 * | 2/2008 | Wissmann et al. | 405/245 |
| 7,404,455 | B2 * | 7/2008 | Yue et al. | 175/27 |
| 7,517,177 | B2 * | 4/2009 | Erdemgil | 405/302.4 |
| 7,721,494 | B2 | 5/2010 | Lee | |
| 8,109,057 | B2 | 2/2012 | Stark | |
| 2003/0066251 | A1 | 4/2003 | Cusimano | |
| 2003/0196393 | A1 | 10/2003 | Bowman et al. | |
| 2004/0093818 | A1 | 5/2004 | Simmons | |
| 2005/0063789 | A1 * | 3/2005 | Gunther | 405/247 |
| 2005/0117977 | A1 * | 6/2005 | Rasumussen | 405/253 |
| 2007/0092341 | A1 * | 4/2007 | Schmertmann et al. | 405/231 |
| 2007/0236272 | A1 | 10/2007 | Min et al. | |
| 2007/0269272 | A1 | 11/2007 | Kothnur et al. | |
| 2007/0269273 | A1 * | 11/2007 | Henderson | 405/239 |
| 2008/0131211 | A1 * | 6/2008 | NeSmith et al. | 405/241 |
| 2009/0003938 | A1 * | 1/2009 | Nishimori | 405/232 |
| 2010/0031589 | A1 | 2/2010 | Fernald et al. | |
| 2010/0038088 | A1 | 2/2010 | Springett et al. | |
| 2011/0042142 | A1 | 2/2011 | Edmonds et al. | |
| 2011/0061321 | A1 | 3/2011 | Phuly | |
| 2012/0096778 | A1 | 4/2012 | Bauletti | |
| 2012/0096786 | A1 | 4/2012 | Salisbury et al. | |

FOREIGN PATENT DOCUMENTS

| | | | | |
|---|---|---|---|---|
| JP | 2003082648 A * | 3/2003 | | E02D 7/22 |
| WO | WO 9316236 A1 * | 8/1993 | | E02D 5/38 |

OTHER PUBLICATIONS

Baker, Michael. LRFD Design Example for Steel Girder Superstructure Bridge. Dec. 2003. Link: www.fhwa.dot.gov/bridge/lrfd/fhwanhi04041_steel.pdf.*

ITCO Allied Engineering. Oct. 2008. Link: http://web.archive.org/web/20081005193306/http://itcoallied.com/id10.html.*

Non-Final Office Action for U.S. Appl. No. 12/813,076, mailed on Oct. 2, 2012, Nickolas G. Salisbury et al., "Batter Angled Flange Composite Cap", 6 Pages.

Non-Final Office Action for U.S. Appl. No. 12/813,030, mailed on Oct. 4, 2012, Nickolas G. Salisbury et al., "Composite Cap", 6 pages.

Non-Final Office Action for U.S. Appl. No. 12/797,887, mailed on Jul. 17, 2012, Kenneth R. Edmonds et al., "Spindrill", 13 pages.

Baker, "LRFD Design Example for Steel Girder Superstructure Bridge", Dec. 2003, pp. 1-pp. 648.

Non-Final Office Action for U.S. Appl. No. 12/797,887, mailed on Mar. 12, 2013, Kenneth R. Edmonds et al., "Spindrill", 10 pages.

Non-Final Office Action for U.S. Appl. No. 12/797,945, mailed on Mar. 6, 2013, Nickolas G. Salisbury et al., "Micropile Foundation Matrix", 22 pages.

Final Office Action for U.S. Appl. No. 12/813,076, mailed on May 28, 2013, Nickolas G. Salisbury et al., "Batter Angled Flange Composite Cap", 8 pages.

* cited by examiner

Example Mast Angle Positions of Rotating Drill

1600

| Tower Details 1602 | | | | | Foundation Details and Decision Matrix 1604 | | | | | | | | | | | | | | | | | | | |
|---|---|---|---|---|---|---|---|---|---|---|---|---|---|---|---|---|---|---|---|---|---|---|---|---|
| Tower No. | Tower Type | Body Extension | Tower Leg Extension (ft) | | Projection (ft) | T.O.C. Elevation (ft) | B.O.C. Elevation (ft) | Bearing Plate Elevation[A] (ft) | 'B' T.O.P. to B.O.C. (ft) | Array Diameter | Batter Angle | Casing Diameter (in) | Rebar Diameter (in) | Strata at 3.0' (Point of Characterization) | No. Piles | N Value | Upper Strata Cased Zone[E] | Min. Casing Embedment into Unit[D] (ft) | N Value | Lower Strata Bond Zone[E] | Min. Bond Length, $L_b$ (ft) | Micropile Type | N Value |
| 29 | EMS | 24 | A | 6 | 0.8 | 2103.3 | 2099.1 | 2100.97 | 1.9 | 33" | 10° | 5 1/2 | 1 3/8 | Loose | 4 | | Loose | 12 | | Loose | 23.5 | B | |
| | | | | | | | | | | | | | | | | | Medium Dense | 10 | | Medium Dense | 16 | B | |
| | | | B | 9 | 2.5 | 2100.3 | 2096.1 | 2097.97 | 1.9 | | | | | | | | Rock | 9 | | Rock | 10 | 0 | |
| | | | | | | | | | | | | | | | | | | | | | | | |
| | | | | | | | | | | | | | | Med Dense Rock | 3 | N29 | Loose | N/A | | Loose | 39 | B | |
| | | | C | 6 | 1.6 | 2103.3 | 2099.1 | 2100.97 | 1.9 | | | | | | | | Medium Dense | 10 | N29 | Medium Dense | 26.5 | B | |
| | | | D | 9 | 0.7 | 2100.3 | 2096.1 | 2097.97 | 1.9 | | | | | | | | Rock | 9 | | N/A | 10 | 0 | N53 |
| | | | | | | | | | | | | | | | | | | | | | | | |
| 30 | EMS | 24 | A | 6 | 0.9 | 2109.6 | 2105.4 | 2107.27 | 1.9 | 33" | 10° | 5 1/2 | 1 3/8 | Loose | 4 | | Loose | 12 | | Loose | 23.5 | B | |
| | | | | | | | | | | | | | | | | | Medium Dense | 10 | | Medium Dense | 16 | B | |
| | | | B | 9 | 2.2 | 2106.6 | 2102.4 | 2104.27 | 1.9 | | | | | | | | Rock | 9 | | Siltstone | 10 | A | |
| | | | | | | | | | | | | | | | | | | | | | | | |
| | | | | | | | | | | | | | | Med Dense Rock | 3 | | Loose | N/A | | Loose | 39 | B | |
| | | | C | 6 | 0.8 | 2109.6 | 2105.4 | 2107.27 | 1.9 | | | | | | | | Medium Dense | 10 | | Medium Dense | 26.5 | B | |
| | | | D | 9 | 0.5 | 2106.6 | 2102.4 | 2104.27 | 1.9 | | | | | | | | Rock | 9 | | Siltstone | 15.5 | A | |
| | | | | | | | | | | | | | | | | | | | | | | | |

Loose: N = 4 - 11 Medium Dense: N = 12 - 39 Rock: N = 40+

Fig. 16

MICROPILE FOUNDATION MATRIX

This application claims the benefit of U.S. Provisional Application No. 61/234,930 filed on Aug. 18, 2009, which is incorporated by reference herein in its entirety.

BACKGROUND

Companies that operate within the geotechnical construction industry often engage in a variety of different excavation projects to install a variety of different structures. For instance, these companies may install a series of lattice towers or mono pole towers that collectively carry power lines or the like from one location to another. In some instances, however, the locations of these tower sites are remote and virtually inaccessible. Because of this inaccessibility, these companies employ techniques to install these towers with fewer materials and smaller tools than compared to traditional techniques used at more accessible sites. While these companies have proven successful at installing structures at remote and inaccessible sites, other more efficient and cost-effective techniques may exist.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to reference like features and components.

FIG. 16 illustrates an example foundation pile schedule and decision matrix for use with the example process of FIGS. 11-15.

DETAILED DESCRIPTION

Figure 1:
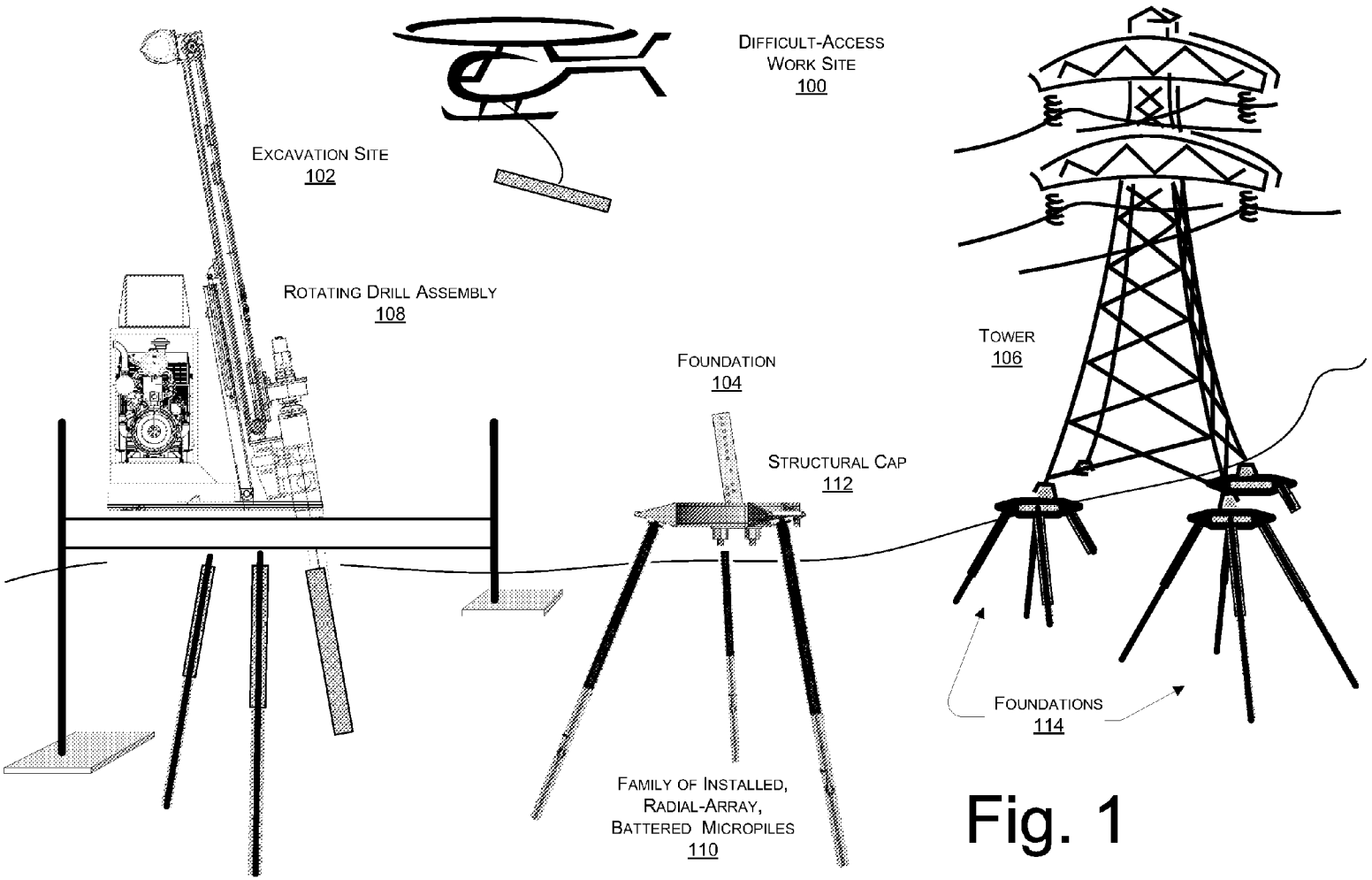
FIG. 1 illustrates an example difficult-access work site. This work site illustrates a lattice tower that has been installed on a radial array of battered micropiles. This works site also includes a rotating drill assembly for excavating a radial array of shafts, as well as a family of radial array battered micropiles coupled together with use of a structural cap having angled bearing flanges.

The disclosure describes, in part, apparatuses and methods for installing structures (e.g., foundations, footings, anchors, abutments, etc.) at work sites, such as difficult-access work sites. For instance, this disclosure describes an apparatus that includes a drill mounted to a rotating member and a sliding member, the combination of which couples to a platform. An operator may employ this rotating drill assembly to excavate a radial array of shafts and thereafter install a radial array of piles, such as a radial array of micropiles. In addition, because this rotating drill assembly comprises multiple detachable components as described in detail below, these components may be transported to a difficult-access work site and assembled directly over a predetermined target at the site. For instance, these components may be flown into the site via a helicopter, driven into the site by trucks or hoisted into the site via a crane and assembled onsite to create the rotating drill assembly.

This disclosure also describes processes for architecting custom structure designs (e.g., pile designs) based at least in part on geotechnical characteristics of particular excavation sites, as well on load requirements of the structure to be attached. For instance, an operator may employ the rotating drill assembly discussed above to perform one or more in-situ (on-site) penetration tests for a particular site. With the results of the penetration tests, the operator or another entity may determine the geotechnical characteristics of the site. The operator or another entity may then use this information in conjunction with a decision matrix described below to determine varying aspects of the structure design, such as a pile design or the like.

For instance, the operator may use the geotechnical characteristics of the site and the decision matrix determine a number of piles to include in a design, a length of a casing of the piles or a bond length of the piles. In some instances, the operator may perform this process at the excavation site and just prior to excavating the shafts and installing the piles. As such, this process may allow the operator to create a custom pile design tailored exactly to the characteristics of the work site just prior to implementing the pile design. Furthermore, in instances where the operator installs a series of structures, such as tower foundations at a tower site, the operator may create custom pile designs for each respective tower foundation as the operator progresses across the tower site.

In addition, this disclosure describes different structural caps that may be used to couple a group of pile together with one another. First, this disclosure describes a structural cap that comprises an outer shell (e.g., made of metal of another material) and a cementitious containment area that may be filled onsite with a cementitious mixture. As described in detail below, this structural cap may provide a strength found in traditional concrete caps, while requiring far less concrete than traditional caps. As such, the structural cap remains lightweight and, thus, more portable to difficult-access sites.

In one example, once an operator installs a group of piles (e.g., a radial array of micropiles) at a difficult-access work site, the operator may couple the installed group of piles with a structural cap that has been transported to the difficult-access site. The operator may then fill the cementitious containment area of the cap with the cementitious mixture, thus reinforcing the structural cap and providing additional strength to the resulting foundation. After a relatively short cure time, the operator or another entity may then couple the secured group of piles to a structure, such as a tower leg or the like.

In addition, this disclosure describes caps having bearing flanges at angles that match a batter angle of an installed group of piles. For instance, if a group of piles is designed to include a particular batter angle, θ, a cap may be similarly designed to include bearing flanges at the angle, θ. When an operator thereafter installs the cap to the group of piles, each pile may perpendicularly mate with an aperture of a respective bearing flange. Therefore, the cap may properly and securely couple to the piles with use of fasteners.

The discussion begins with a section entitled "Example Difficult-Access Work Site," which describes one example environment in which the described apparatuses and methods may be implemented. A section entitled "Example Rotating Drill Assembly and Assembly Process" follows, and describes details of the rotating drill assembly from FIG. 1. This section also describes one example process for assembling the rotating drill at the difficult-access work site of FIG. 1 or otherwise. The discussion then proceeds to describe "Example Rotating Drill Assembly Adjustments" and example ways in which an operator may utilize the rotating drill assembly.

Next, a section entitled "Example Process for Architecting Custom Structure Designs" illustrates and describes a process for creating custom designs (e.g., pile designs) based at least in part on geotechnical characteristics specific to a work site. This section also includes an example foundation schedule that includes a decision matrix for use with the process described immediately above. A section entitled "Example Structural Caps and Associated Process" follows. This section describes both example structural caps for coupling piles, anchors or the like with one another, as well as an example process for designing and installing these caps. Finally, a brief conclusion ends the discussion.

This brief introduction, including section titles and corresponding summaries, is provided for the reader's convenience and is not intended to limit the scope of the claims, nor the proceeding sections.

Example Difficult—Access Work Site

FIG. 1 illustrates an example difficult-access work site 100 in which the described apparatuses and methods may be implemented. Difficult-access work site 100 depicts multiple stages that occur in the process of installing one or more structures at work site 100. Here, for instance, work site 100 illustrates several stages necessary to install a series of lattice towers designed to carry power lines or the like. While FIG. 1 illustrates constructing foundations and installing lattice towers thereon, the techniques described herein may be used to construct foundations, footings, anchors or the like for installing monopole towers, lattice towers or any other similar or different structure(s).

For instance, work site 100 illustrates an excavation site 102, a completed foundation 104 and an installed tower 106. Excavation site 102 represents a first stage of a process in constructing a tower at work site 100. Here, an operator of work site 100 may use a rotating drill assembly 108, described in detail below, to excavate one or more shafts, such as a radial array of shafts.

Next, foundation 104 represents a second stage in the process of constructing a tower. Here, the operator of the site has installed a family of radial-array, battered micropiles 110 within the excavated shafts. While FIG. 1 shows a radial array of micropiles, other implementations may employ other types of piles, anchors (e.g., rock anchors), or the like. In addition, FIG. 1 illustrates that the operator has coupled piles 110 together via a structural cap 112. In some instances described below, structural cap 112 may comprise a composite cap and/or other type of structural cap having flanges angled to match the batter angle of installed piles 110.

Finally, FIG. 1 illustrates, on the right-hand side of the illustration, that the operator of site 100 has installed tower 106 to multiple foundations 114. As illustrated, each of foundations 114 comprises a family of radial-array, battered micropiles 110 coupled with a structural cap 112.

Because work site 100 may comprise a remote and virtually inaccessible environment, helicopters, cranes or other transportation means may support work site 100. In these instances, these transportation means function to deliver materials and tools to work site 100. For instance, the helicopter illustrated in FIG. 1 may provide drills, platforms, piles, structural caps, tower components or any other tools or components needed at site 100 to complete the foundations and towers coupled thereto. Because an operator of site 100 may need to deliver these tools and components to site 100 via a helicopter or the like, these tools and components may be relatively small and lightweight.

For instance, returning to excavation site 102, the illustrated helicopter may transport components of rotating drill assembly 108 to work site 100. After the helicopter transports the components of drill assembly 108, an operator of work site 100 may assemble rotating drill assembly 108. In addition, the helicopter may transport the materials necessary to install micropiles 110, structural cap 112, as well as tower 106.

Having described one example environment in which the apparatuses and methods described in detail below may be implemented, the discussion moves to a discussion of rotating drill assembly 108 and an example process for assembling this drill assembly. The reader will appreciate, however, that difficult-access work site 100 comprises but one of many environments that may implement the described apparatuses and methods.

Example Rotating Drill Assembly and Assembly Process

FIGS. 2-6 illustrate details of rotating drill assembly 108 of FIG. 1, as well as an example process 200 for assembling the drill assembly. In some instances, this process may be performed at a difficult-access work site, such as work site 100 of FIG. 1, after a helicopter or other transportation means transfers components of rotating drill assembly 108 to site 100. The order in which the operations are described in process 200 (as well as the remaining processes described herein) is not intended to be construed as a limitation, and any number of the described operations can be combined in any order and/or in parallel to implement the process. In addition, while process 200 is described as being performed by a same actor, the described operations may be performed by multiple different actors in some instances.

Figure 2:
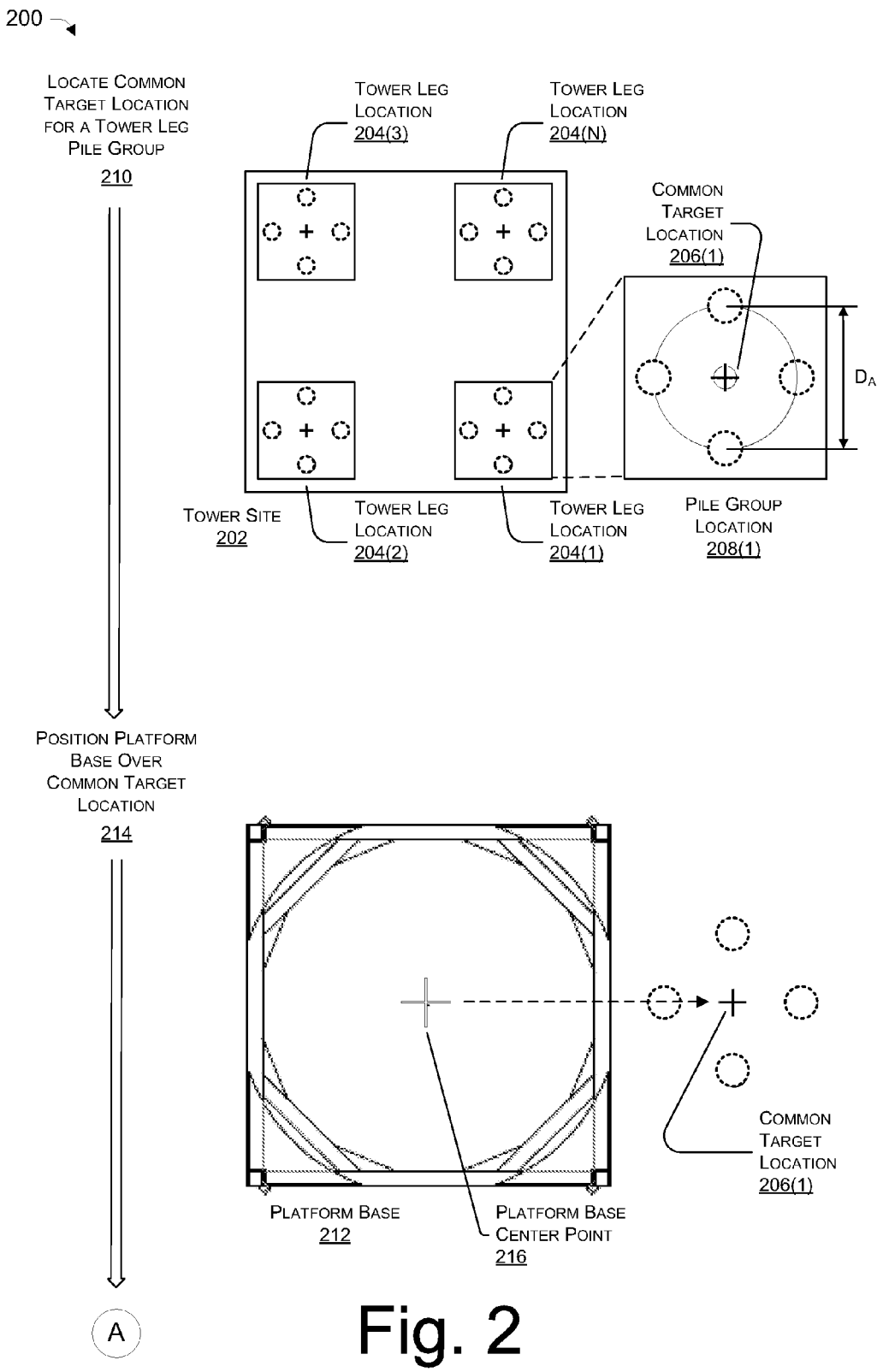
FIGS. 2-6 illustrate details of the rotating drill assembly of FIG. 1, as well as an example process for assembling the rotating drill assembly. In some instances, this process may be performed at a difficult-access work site, such as the site of FIG. 1.

FIG. 2 first illustrates on the top-right portion of the figure a tower site 202 where an operator of the site plans to install a tower. For instance, this tower site may comprise one site of multiple tower sites that will collectively comprise a series of towers carrying power lines or the like. Tower site 202 may comprise one or more tower leg locations 204(1), 204(2), . . . 204(N). Here, for instance, tower site 202 comprises four tower leg locations, each of which correspond to a leg of a lattice tower to be installed at tower site 202.

At each tower leg location 204(1)-(N) an operator of tower site 202 may first excavate one or more shafts to make way for a corresponding number of piles. For instance, the operator may install a radial array of micropiles at each tower leg location 204(1)-(N). In these instances, FIG. 2 illustrates that each of the tower leg locations may comprise a common target location 206(1) designating a location 208(1) of a pile group to be installed. Stated otherwise, pile group location 208(1) comprises a location where the operator plans to excavate the shafts and install the piles (shown in broken lines). In instances where the piles to be installed comprise a radial array of piles having a predetermined array diameter (DA), common target location 206(1) comprises a center point of this array diameter.

With this illustration in mind, process 200 begins at operation 210, which represents locating common target location 206(1) for one pile group location 208(1). After locating common target location 206(1), an operator of the site may transport (e.g., via helicopter, crane, truck or the like) a platform base 212 to tower site 202. Platform base 212 generally comprises multiple (e.g., four) adjustable legs extending downward from respective corners of a platform. Additionally, platform base 212 further comprises a large, substantially circular opening for receiving a portion of the rotating drill assembly, described below. Of course, while the described implementation includes circular members, each component of rotating drill assembly 108 may comprise any shape or form in other implementations.

Process 200 continues at operation 214, which represents positioning platform base 212 over common target location 206(1). The operator may utilize the helicopter, crane or the like to position a center point 216 of platform base 212 over common target location 206(1). In addition, the operator may adjust the legs of platform base 212 to level the platform of platform base 212. That is, the operator may adjust the legs of platform base with the contour of the underlying ground in order to create a level surface on the top of platform base 212.

Figure 3:
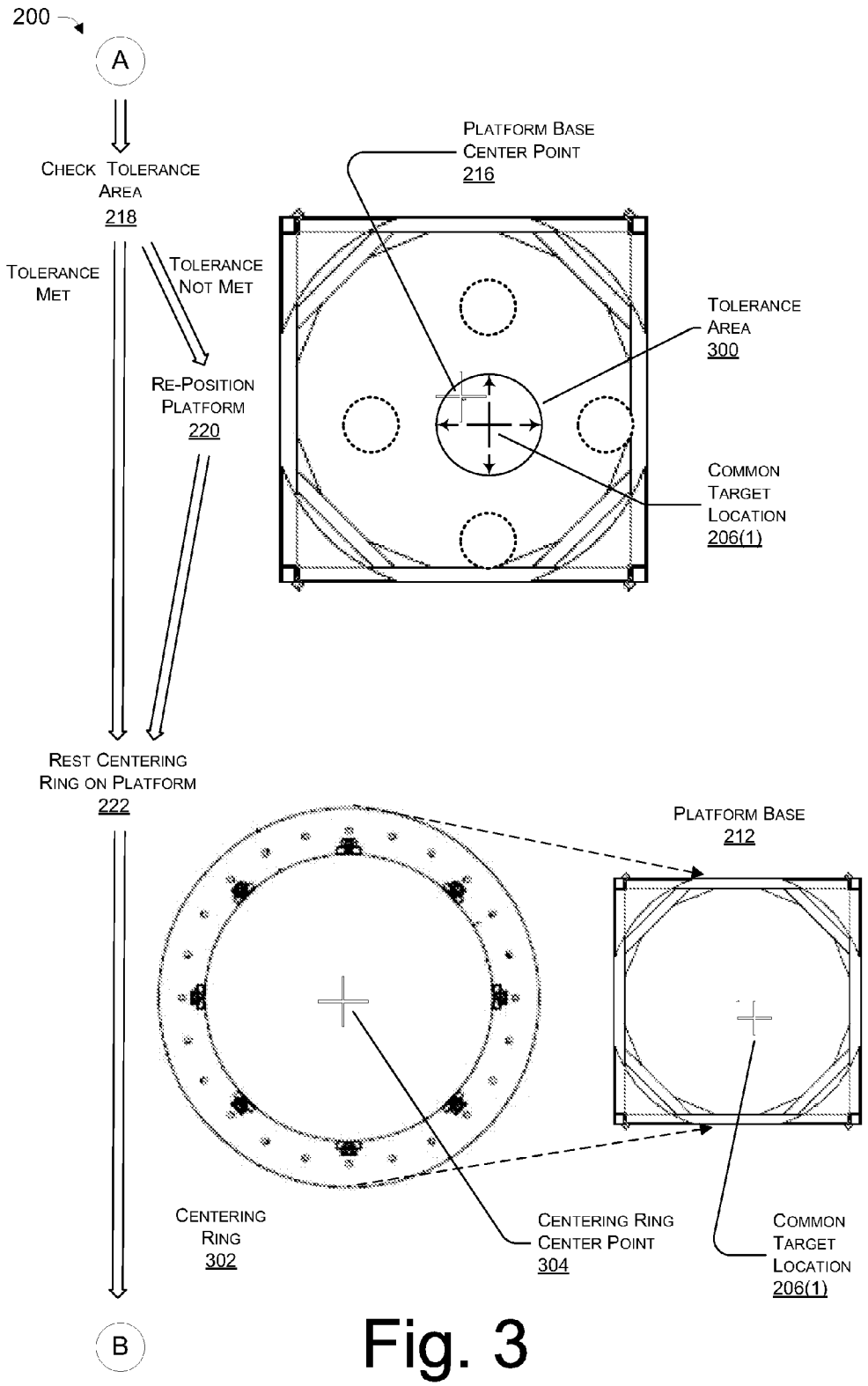

Process 200 continues with operation 218 at the upper right portion of FIG. 3. Operation 218 involves the operator checking that platform base center point 216 is located within a tolerance area 300 surrounding common target location 206 (1). For instance, tolerance area 300 may comprise a diameter of between two inches and two feet (or any other diameter), in which case the operator may determine whether or not center point 216 of platform base 212 is within this defined range.

If the operator determines during operation 218 that the tolerance is not met (i.e. the platform base center point 216 is not within tolerance area 300), then the operator performs operation 220. Operation 220 instructs the operator to reposition platform base 212 so that platform base center point 216 is within tolerance area 300 and, therefore, so that the tolerance is met. With platform base center point 216 within tolerance area 300, platform base 212 provides a positioned first plane for the remaining portions of the drill to be properly assembled as described below. In some instances, this first plane comprises a flat and level plane upon which additional components of rotating drill assembly 108 may mount.

Process 200 continues with operation 222, illustrated at the lower-right portion of FIG. 3. Operation 222 describes resting a centering ring 302 (having a large, substantially circular opening) on platform base 212. In some instances, platform base 212 comprises a recessed socket for receiving centering ring 302. That is, platform base 212 comprises an area that is designed to securely receive centering ring 302 that is located near the outer perimeter of platform base 212. In some instances, this socket includes a float distance in which the operator may adjust the position of centering ring 302 within the socket of platform base 212. In addition, a portion of the opening of platform base 212 resides beneath the opening of centering ring 302, both of which may receive a portion of a drill as described below.

When resting centering ring 302 on platform base 212, the operator may utilize a helicopter, crane or any other similar or different transportation mechanism. As described above, platform base 212 has been positioned over common target location 206(1) such that platform base center point 216 is within tolerance area 300. This allows the operator to rest centering ring 302 on platform base 212 such that a center point 304 of centering ring 302 is also within tolerance area 300 and, therefore, resides over common target location 206 (1) within the predefined tolerance.

Figure 4:
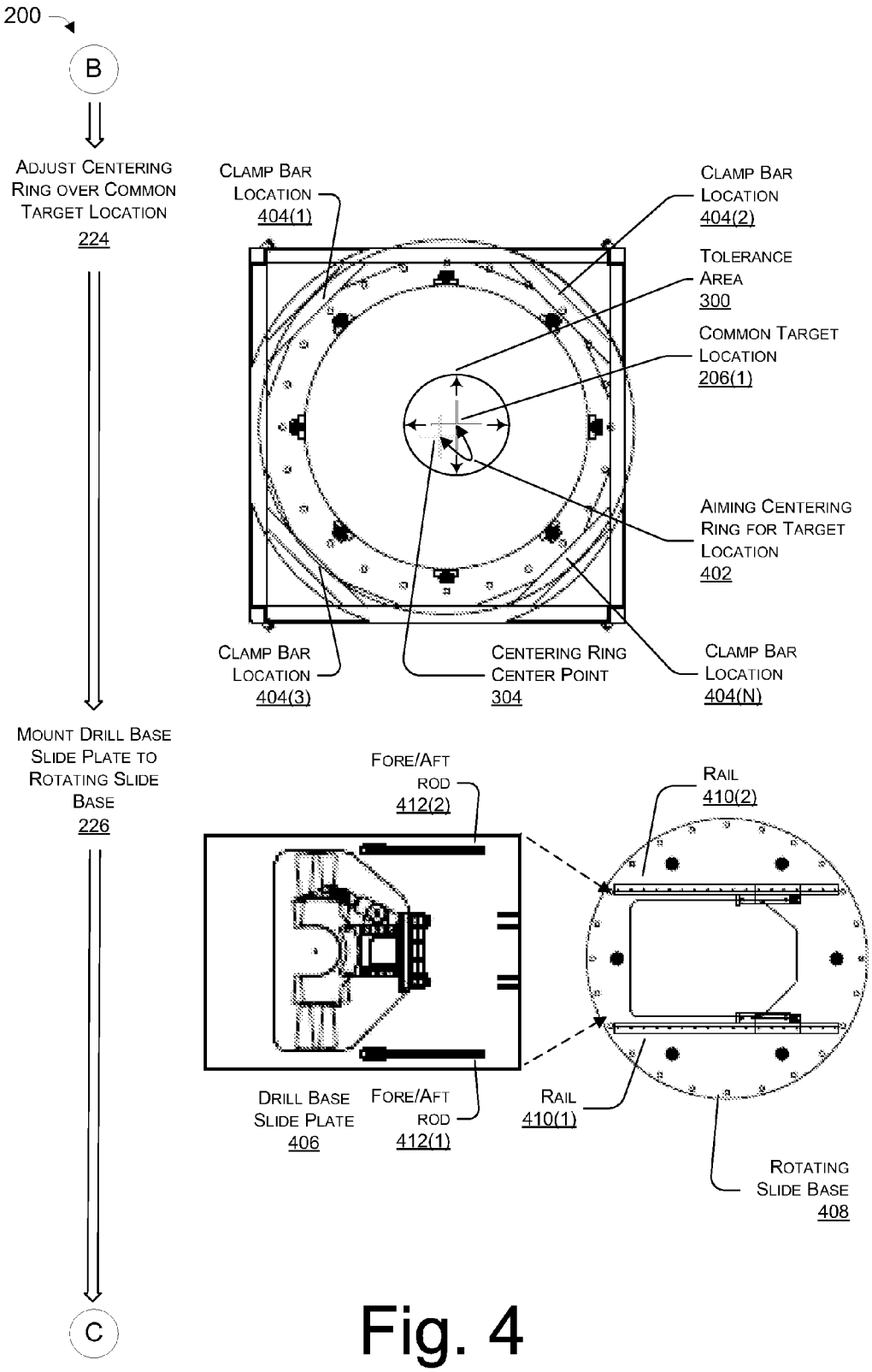

After the operator has performed operation 222, process 200 continues at FIG. 4 with operation 224. Operation 224 represents adjusting centering ring 302 over common target location 206(1) on platform base 212 to more closely align center point 304 of centering ring 302 with common target location 206(1). With centering ring 302 resting on platform base 212, centering ring 302 defines a second plane that is parallel or substantially parallel to the first plane. As such, the operator is free to adjust centering ring 302 on platform base 212 in any direction within the second plane. Again, this adjustability allows the operator to aim centering ring 302 towards target location 206(1), as arrow 402 illustrates.

With the centering ring 302 properly adjusted such that centering-ring center point 304 is in-line with common target location 206(1) (i.e., is directly over target location 206(1)), the operator may choose to securely fix centering ring 302 to platform base 212. While the operator may choose to securely fix centering ring 302 in the adjusted position in any number of ways, FIG. 4 illustrates that the operator may do so with one or more clamp bars at clamp bar locations 404(1), 404(2), . . . , 404(N).

Process 200 continues with operation 226, illustrated at the lower-right portion of FIG. 4. Operation 226 shows that a drill base slide plate 406 may mount to a rotating slide base 408 via rail 410(1) and rail 410(2). Here, drill base slide plate 406 is shown with fore/aft adjust cylinder rod 412(1) and fore/aft adjust cylinder rod 412(2). Fore/aft adjust cylinder rods 412 (1) and 412(2) connect to rotating slide base 408 and provide means for linearly moving drill base slide plate 406 along rails 410(1) and 410(2) in either a fore direction or aft direction, as described below in greater detail. Stated otherwise, when drill base slide plate 406 mounts to rotating slide base 408 (and after complete assembly of rotating drill assembly 108), an operator of the drill may linearly adjust drill base slide plate 406 along rotating slide base 408.

In addition and as illustrated, both drill base slide plate 406 and rotating slide base 408 may also comprise respective large openings disposed in the middle of these components. When rotating slide base 408 (and drill base slide plate 406) mounts to centering ring 302, as described immediately below, the opening of rotating slide base 408 and drill base slide plate 406 may reside above the openings of centering ring 302 and platform base 212. Similar to these previously discussed openings, the openings of rotating slide base 408 and drill base slide plate 406 may receive a portion of a drill, as discussed below.

While process 200 describes mounting drill base slide plate 406 to rotating slide base 408 after adjusting centering ring 302 over common target location 206(1), in some instances drill base slide plate 406 may be mounted to rotating slide base 408 at any other sequence location of process 200. Furthermore, in other instances, drill base slide plate 406 may be integral with rotating slide base 408.

Figure 5:
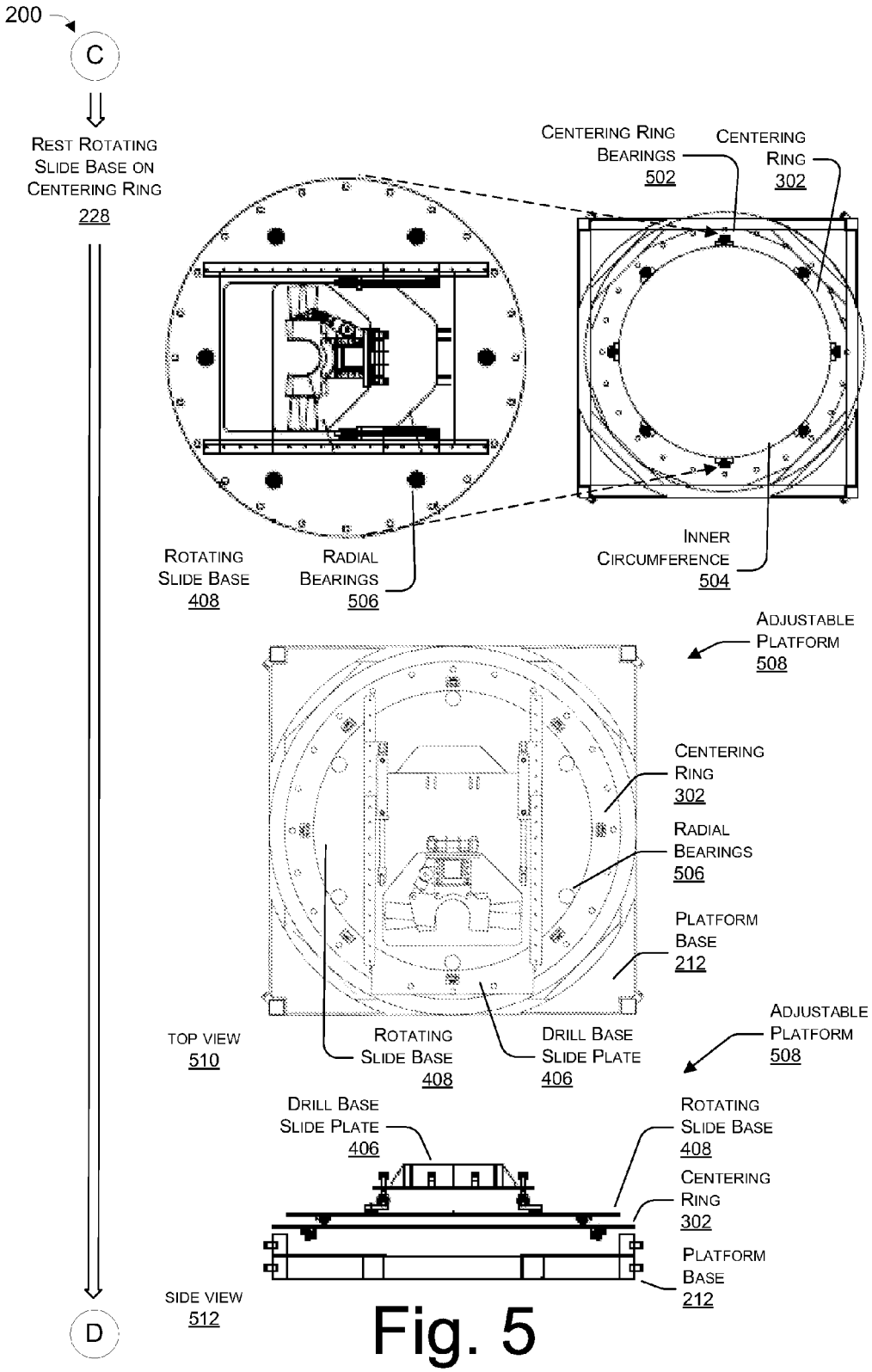

The upper right-hand portion of FIG. 5 continues process 200 at operation 228. Operation 228 represents resting rotating slide base 408 on centering ring 302 in a third plane that is substantially parallel to the first and second planes described above. Again, the operator of the work site may rest this component on centering ring 302 via a helicopter, crane or in any other suitable manner. In some implementations, one or more bearings may reside in between rotating slide base 408 and centering ring 302. For instance, one or both of rotating slide base 408 and centering ring 302 may include one or more bearings, such as one or more plain bearings, rolling element bearings, jewel bearings, fluid bearings, magnetic bearings, flexure bearings and the like.

Furthermore and as illustrated, these bearings may reside on an outer perimeter of rotating slide base 408 and/or centering ring 302. For instance, the bearings may reside two times closer, four times closer, etc. to an outer edge of the rotating slide base 408 or centering ring 302 than to a center point of these components.

In the illustrated embodiment, rotating slide base 408 rests on bearings 502 disposed on centering ring 302. Meanwhile, an inner circumference 504 of centering ring 302 provides a bearing surface for radial bearings 506 disposed on rotating slide base 408. As such, rotating slide base 408 securely attaches both axially and radially to centering ring 302. In addition, with use of centering-ring bearings 502 and radial bearings 506, rotating slide base 408 is configured to rotate 360 degrees in a clockwise and counter-clockwise direction on centering ring 302 and about a center point of rotating slide base 408. In addition, because rotating slide base 408 mates directly on top of centering ring 302, rotating slide base 408 also rotates about center point 304 of centering ring 302 and, hence, about common target location 206(1).

While process 200 describes resting rotating slide base 408 with drill base slide plate 406 on centering ring 302 at operation 228, other implementations rest rotating slide base 408 on centering ring 302 followed by mounting drill base slide plate 406 to rotating slide base 408.

After resting rotating slide base 408 on centering ring 302, an adjustable platform 508 configured to hold a drill and a motor has been defined and assembled. A top view 510 of this adjustable platform and a side view 512 of adjustable platform 508 are shown respectively in the middle and lower right-hand portions of FIG. 5.

Figure 6:
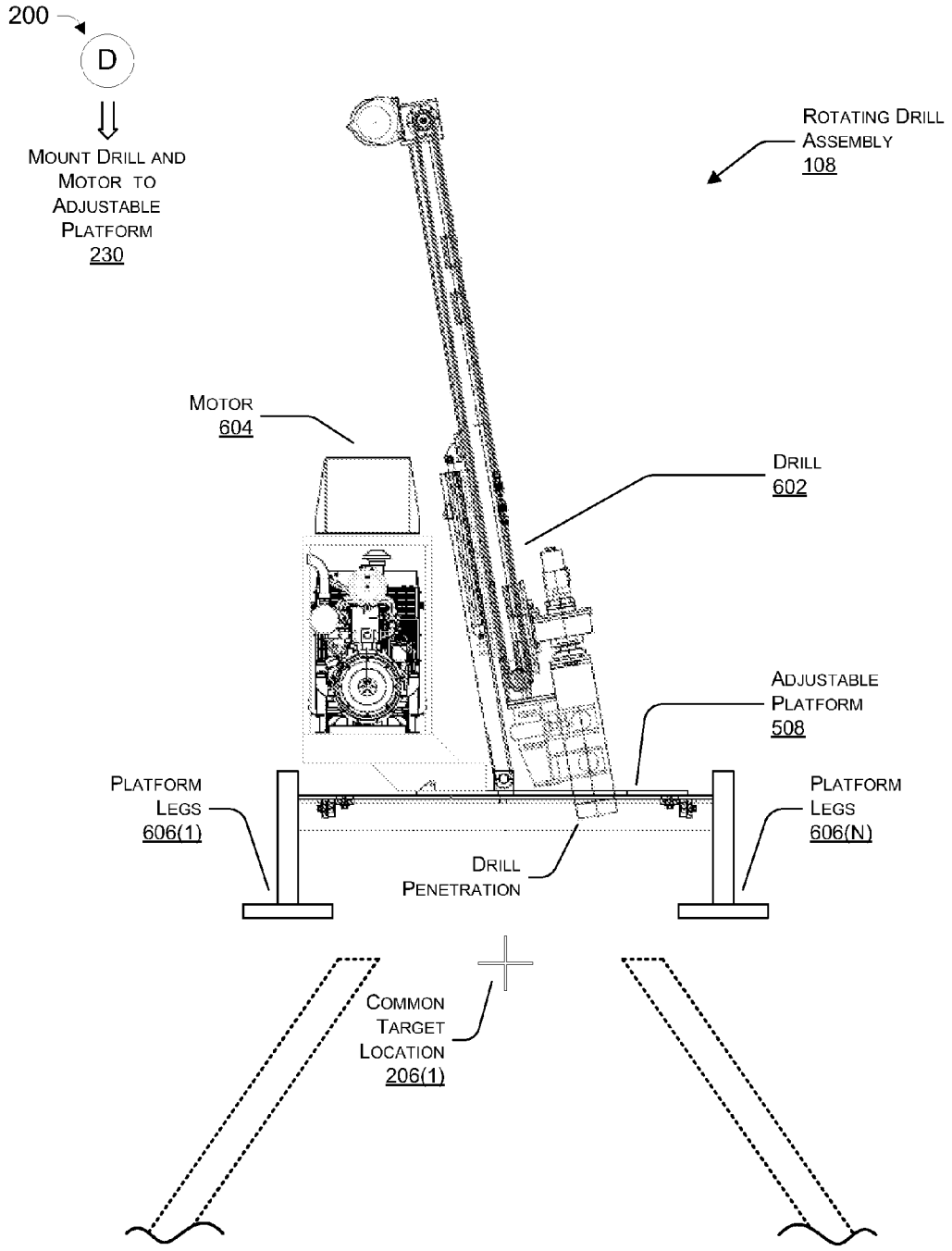

Finally, operation 230 completes process 200 at FIG. 6. As illustrated, operation 230 represents mounting a drill 602 and a motor 604 to adjustable platform 508. Again, the operator may employ a crane, helicopter or the like to position drill 602 and motor 604 on adjustable platform 508. One or more platform legs 606(1), . . . , 606(N) (discussed above at operation 214) position drill 602, motor 604 and adjustable platform 508 over common target location 206(1). Taken together, drill 602, motor 604 and adjustable platform 508 may define rotating drill assembly 108 illustrated in and described with reference to FIG. 1. As discussed both above and below, the operator of the work site (e.g., difficult-access work site 100) may employ rotating drill assembly 108 to excavate one or more shafts around common target location 206(1) to install, for example, a radial array of batter-angled micropiles ("battered micropiles").

As described more fully below, the operator may operate rotating drill assembly 108 by rotating adjustable platform 508, securing the platform in place and operating drill 602. Because each component of adjustable platform 508 includes an opening in the middle of the respective component, drill 602 may enter through the collective opening in the middle of adjustable platform 508 and into the drilling surface, as FIG. 6 illustrates.

Example Rotating Drill Assembly Adjustments

Figure 7:
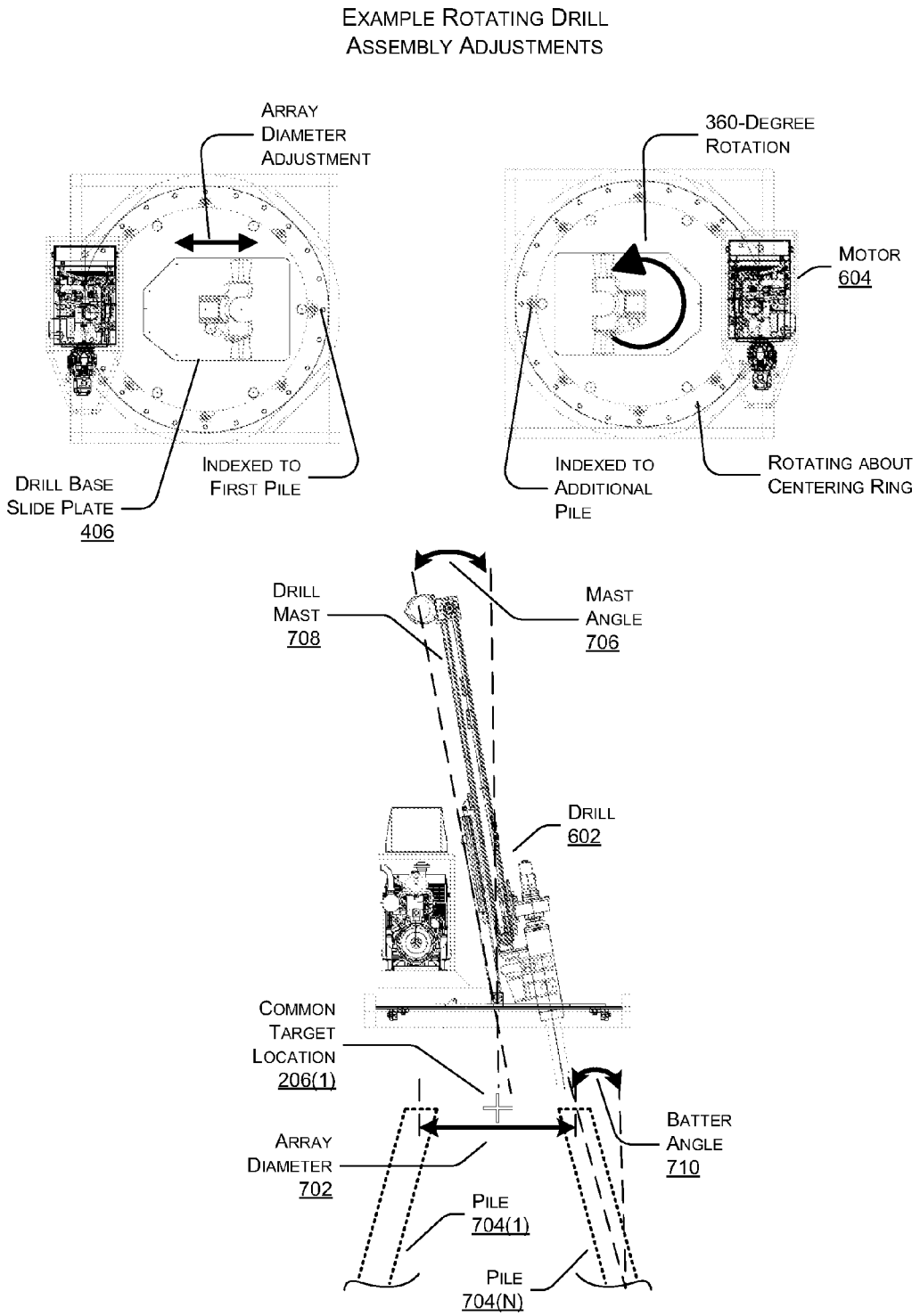
FIG. 7 illustrates example ways in which an operator of a rotating drill assembly may adjust the drill for the purpose of excavating shafts according to a pile design. Here, an operator may slide, rotate and alter an entry angle of the drill.

FIGS. 7-10 collectively illustrate example ways in which an operator of difficult-access rotating drill assembly 108 may adjust the drill for the purpose of excavating shafts according to a pile design. First, FIG. 7 illustrates, at a high level, rotating drill assembly 108 adjusting in multiple different manners. Each of FIGS. 8-10 proceeds to illustrate these adjustments in more detail. For clarity of illustration, portions of FIGS. 7-9 do not illustrate drill 602 as a part of rotating drill assembly 108. By adjusting rotating drill assembly 108 in each of the manners discussed in detail below, assembly 108 allows an operator to create a radial array of piles having characteristics (e.g., diameter, batter angle, elevation of piles above grade, etc.) specified by a pile design.

The upper-left portion of FIG. 7 represents linearly adjusting drill 602 and motor 604 on drill base slide plate 406. The drill and motor may slide backwards or forwards along rails 410(1) and 410(2) via drill base slide plate 406 and fore/aft rods 412(1) and 412(2). As described in greater detail in FIG. 8, this slide adjustment allows the operator to slide the drill to a position that matches an array diameter 702 of piles 704(1), . . . , 704(N) (shown in lower portion of FIG. 7).

Figure 9:
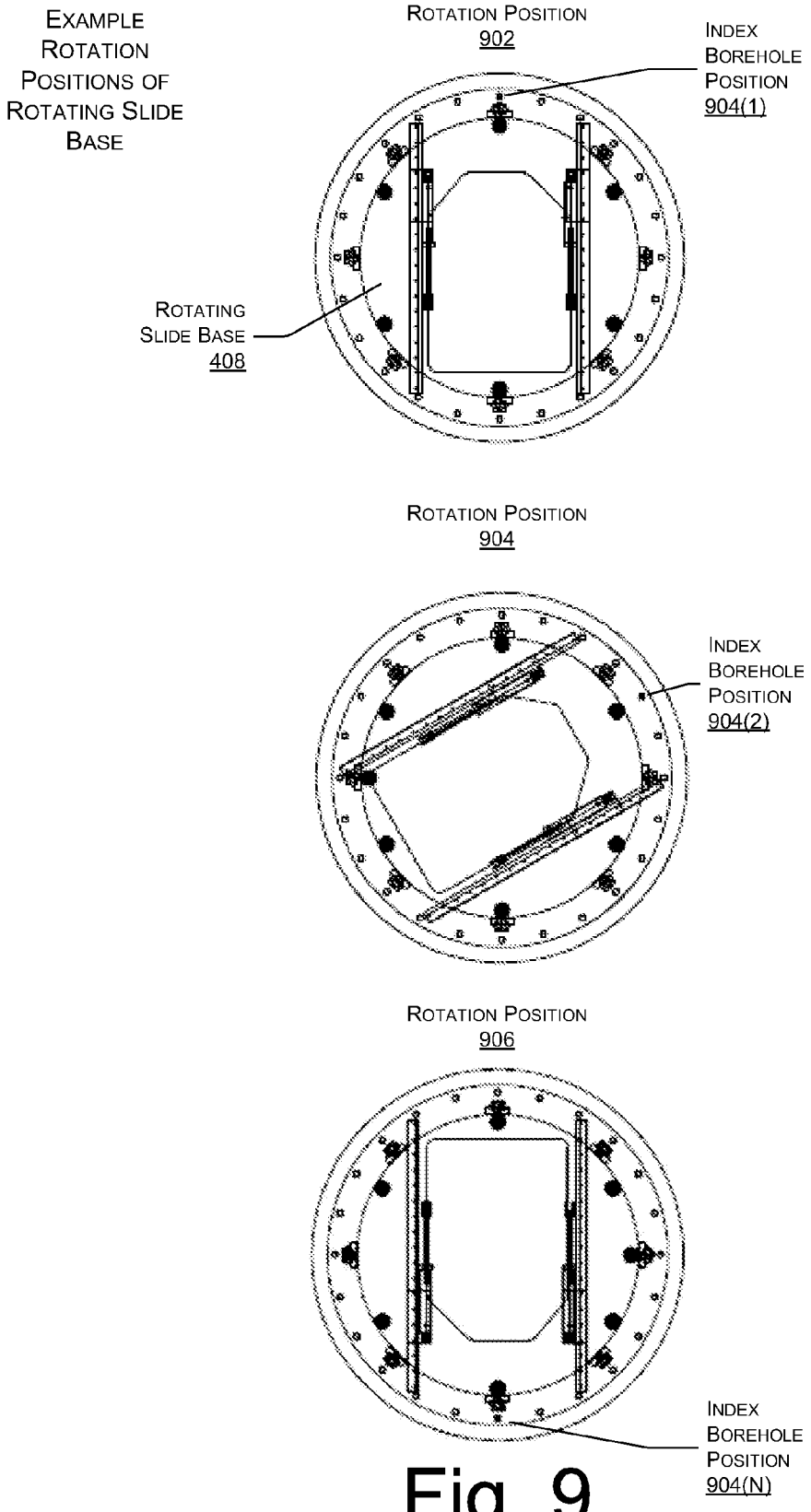
FIG. 9 illustrates example rotation positions of a rotating slide base upon which the drill mounts. An operator of the drill assembly may rotate the rotating slide base and mounted drill to each position associated with a shaft to be excavated according to the pile design.

Next, the upper-right portion of FIG. 7 represents a drill and motor rotation adjustment. As described above, drill 602 and motor 604 may rotate 360 degrees in a clockwise or counter-clockwise direction via rotating slide base 408 and the bearings disposed beneath base 408. This 360-degree rotation allows the operator to index the drill to multiple different index positions about common target location 206 (1). More specifically, the upper-right portion of FIG. 7 shows a counter-clockwise rotation about fixed centering ring 302 such that drill 602 and motor 604 are indexed to a different pile position than the first pile position illustrated in the upper-left portion of FIG. 7. FIG. 9 describes this rotation adjustment in greater detail.

Finally, the lower portion of FIG. 7 represents adjusting an angle 706 of a mast 708 of drill 602. An operator may adjust mast 708 such that mast angle 706 matches a designed batter angle 710 of piles 704(1), . . . , 704(N). After having linearly and rotationally adjusted drill 602, and after having adjusted mast angle 706 of drill mast 708, the operator has positioned drill 602 to excavate pile 704(N) according to the predetermined pile design. It is to be appreciated, however, that an operator of rotating drill assembly 108 may perform any of the adjustments illustrated in FIG. 7 in any order.

Figure 8:
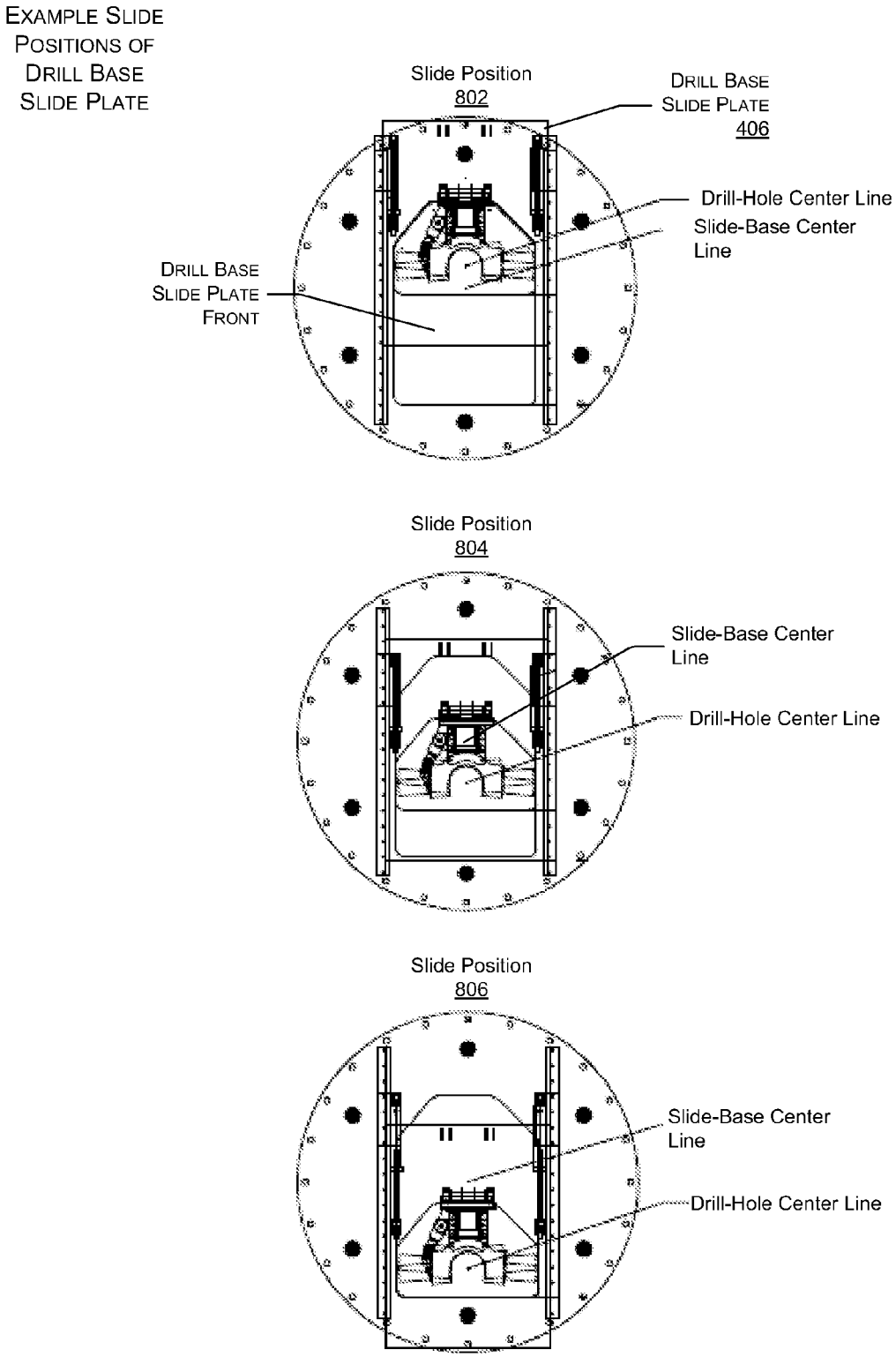
FIG. 8 illustrates example slide positions of a drill base slide plate upon which the drill mounts. An operator of the drill assembly may slide the drill base slide plate and mounted drill to excavate a radial array of shafts at a predetermined diameter of the pile design.

FIG. 8 illustrates linearly adjusting rotating drill assembly 108 in greater detail. Specifically, FIG. 8 illustrates three example slide positions 802, 804 and 806 of drill base slide plate 406 upon which drill 602 mounts. Typically, the operator of rotating drill assembly 108 may determine a predetermined array diameter of a pile design before sliding drill base slide plate 406 to a proper slide position (e.g., position 802, 804 or 806) to achieve this predetermined diameter.

In some instances, illustrated slide positions 802, 804 and 806 represent respective positions that an operator of the drill may employ to excavate a radial array of shafts at a predetermined diameter of a pile design. First, slide position 802 illustrates that a drill-hole center line resides behind a slide base center line. As such, slide position 802 represents a position where a portion of drill 602 penetrates adjustable platform 508 behind the slide base center line. Further, slide position 802 allows the drill to penetrate the platform behind center point 304 of centering ring 302, which aligns with common target location 206(1) as discussed above. By positioning drill base slide plate 406 in this manner, the operator is able to excavate a radial array of shafts at a relatively tight diameter of a pile design.

As mentioned above, centering-ring bearings 502 that are disposed along a perimeter of centering ring 302 and radial bearings 506 that are disposed along a perimeter of rotating slide base 408 enable slide position 802. That is, because both the bearings 502 and bearings 506 reside at an outer perimeter of adjustable platform 508 (rather than in a middle or center point of the platform), the adjustable platform provides an opening in the middle of the platform to receive a portion of drill 602. This opening at the center of the adjustable platform allows drill 602 to penetrate adjustable platform 508 in any of slide positions 802, 804 or 806 or in any other of a multitude of positions.

Slide positions 804 and 806, meanwhile, represent slide positions where the drill-hole center line resides in front of the slide-base center line. As such, an operator may use these slide positions to achieve respective array diameters that are greater than the array diameter achieved via slide position 802.

FIG. 9 illustrates example rotation positions 902, 904 and 906 of rotating slide base 408 upon which drill base slide plate 406 and drill 602 mounts. By allowing an operator of rotating drill assembly 108 to rotate the assembly in this manner, the operator is able to excavate the number of shafts and install the number of piles called for by a pile design. For instance, if the pile design calls for a radial array of four piles, then the operator may rotate and position rotating slide base 408 to each of the four pile locations to excavate a shaft and install a pile at each location. In the illustrated example, for instance, the operator may excavate a first shaft and install a pile at position 902, may excavate a second shaft and install a second pile at position 904 and may excavate yet another shaft and install yet another pile at position 906.

In order to secure rotating slide base 408 at a particular rotation position, adjustable platform 508 may include one or more index boreholes 908(1), 908(2), . . . , 908(N). As illustrated, index boreholes 908(1)-(N) are located near the outer perimeter of centering ring 302 and rotating slide base 408. In some instances, index boreholes 908(1)-(N) reside within both centering ring 302 and rotating slide base 408. As such, an operator may rotate rotating slide base 408 and mounted drill 602 to any index borehole locations relative to fixed centering ring 302 and may fasten rotating slide base 408 by inserting a pin or the like into one or more of index boreholes 908(1)-(N). While FIG. 9 illustrates securing rotating slide base 408 via pins inserted into one or more of boreholes 908(1)-(N), other implementations may secure rotating slide base 408 at different positions in array of other suitable manners (e.g., via clamps, notches, etc.).

In some instances, adjustable platform 508 may be designed to allow an operator to excavate a quantity of evenly-distributed array of shafts, with the quantity being a divisor or a multiple of 24. For instance, adjustable platform 508 may be designed to allow an operator to excavate an evenly-distributed array of shafts in the following quantities: 2, 3, 4, 6, 8, 12, 24, 48 etc. To do so, rotating slide base 408 may comprise 24 index boreholes 908(1)-(N).

Figure 10:
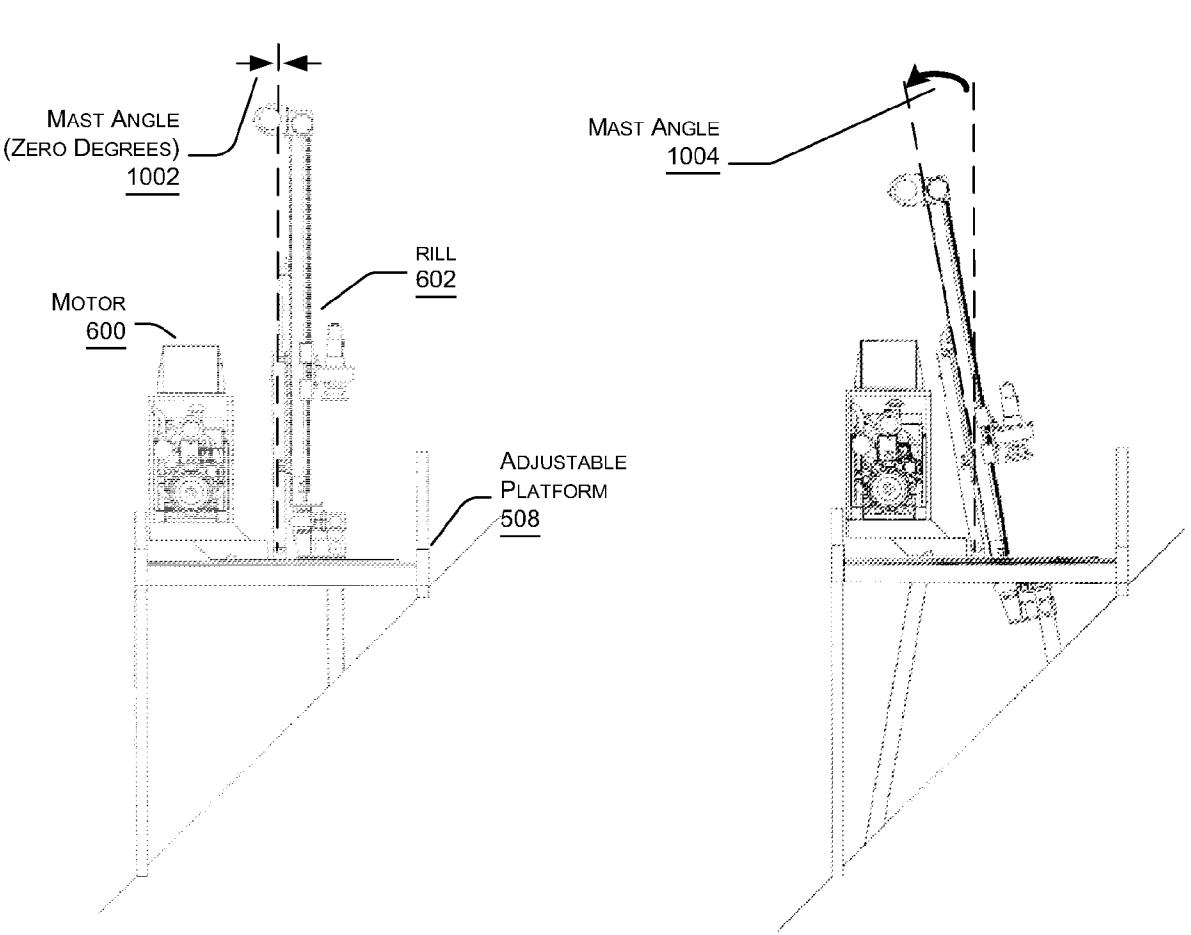
FIG. 10 illustrates example entry angle positions of the drill of the rotating drill assembly. An operator of the drill assembly may alter the entry angle of the drill to match a predetermined batter angle, as specified by the pile design.
Figure 11:
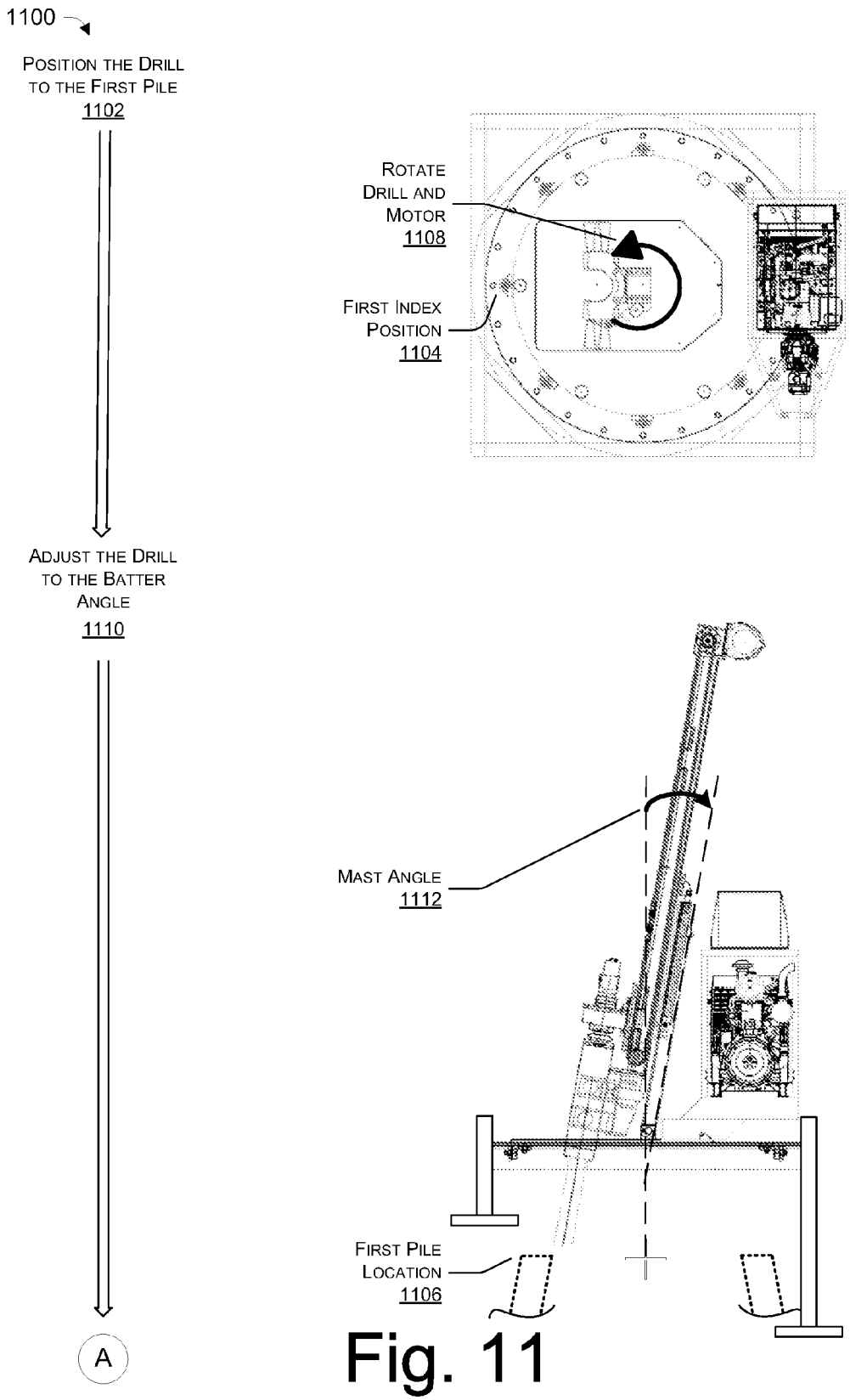
FIGS. 11-15 illustrate an example process for architecting a custom pile design based at least in part on geotechnical characteristics of a particular excavation site. For instance, an operator may perform this process to determine a number of piles to include in the design, a length of a casing of the piles or a bond length of the piles. In some instances, the operator may perform this process at the excavation site and just prior to excavating the shafts and installing the piles.

FIG. 10 illustrates example mast angle positions 1002 and 1004 of drill 602 of rotating drill assembly 108. As discussed above, an operator of rotating drill assembly 108 may alter the mast angle (i.e., the entry angle of the drill) to match a predetermined batter angle at which a radial array of piles are to be installed, as specified by the pile design. The left portion of FIG. 10 illustrates a mast angle position 1002 of zero degrees. At this position, the drill will excavate a substantially vertical shaft for a substantially vertical pile (i.e., a pile having no batter angle or a batter angle of zero degrees). The right side of FIG. 7, meanwhile, illustrates a mast angle position 1004 of some positive angle that is greater than zero but less than ninety degrees. Here, the drill will excavate a shaft according to this mast angle, resulting in a pile having a batter angle equal to the mast angle.

Example Process for Architecting Custom Structure Designs

FIGS. 11-15 illustrate an example process 1100 for architecting a custom pile design based at least in part on geotechnical characteristics of a particular excavation site, such as difficult-access work site 100, as well as on load requirements of the structure to be attached to the resulting pile. For instance, an operator may perform this process to determine a number of piles to include in the design, a length of a casing of the piles a bond length of the piles or any other aspect of the pile design. In some instances, the operator may perform this process at the excavation site and just prior to excavating the shafts and installing the piles. While FIGS. 11-15 illustrate a process for architecting a pile design, it is to be appreciated that this process may apply to architecting designs of any type of structural members (e.g., rock anchors, micropiles, substitute piles, replacement piles, etc.).

Process 1100 includes an operation 1102, which represents positioning drill 602 to a first index position 1104 associated with a location 1106 of a first pile to be installed at an example tower site. As arrow 1108 represents, an operator may rotate and secure rotating slide base 408 and drill 602 to first index position 1104. Next, process 1100 proceeds to operation 1110, which represents an operator adjusting drill 602 to a mast angle 1112. In some instances, mast angle 1112 matches a predetermined batter angle for the first pile.

Figure 12:
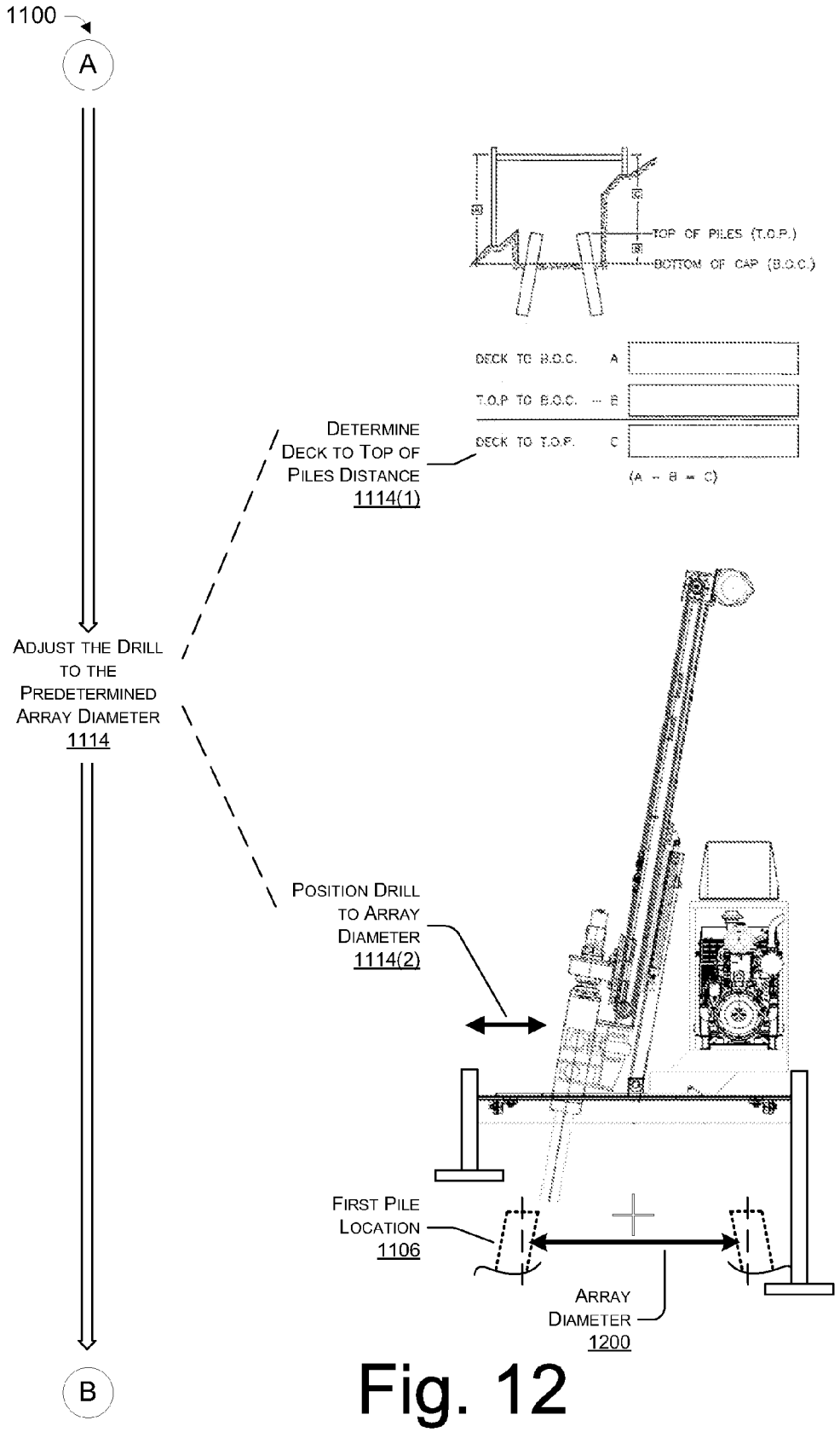

FIG. 12 continues the illustration of process 1100 and includes an operation 1114, which comprises two sub-operations 1114(1) and 1114(2). Here, the operator may adjust drill base slide plate 406 to match a predetermined diameter 1200 of the radial array of piles to be installed.

At sub-operation 1114(1), an operator may determine a distance between a desired top of the radial array of piles and platform base 212 (i.e., the "deck"). To do so, the operator may first measure a distance between platform base 212 and a bottom of an excavation, upon which a bottom of a cement structural cap may sit after completion of the piles in implementations that employ such a cap. Next, the operator may measure a distance between the desired top of the radial array of piles and the bottom of the excavation. Finally, the operator may subtract the latter measured distance from the former measured distance to determine the distance between the desired top of the radial array of piles and the platform base 212.

With this distance information, along with the predetermined array diameter and batter angle, the operator may determine (e.g., mathematically or with reference to a chart) a linear location at which to station drill base slide plate 406 and drill 602 to achieve this diameter. After determining this linear location, the operator may proceed to position drill base slide plate 406 and drill 602 accordingly at sub-operation 1114(2). At this point, drill 602 of rotating drill assembly 108 points towards desired location 1106 of a first pile.

Figure 13:
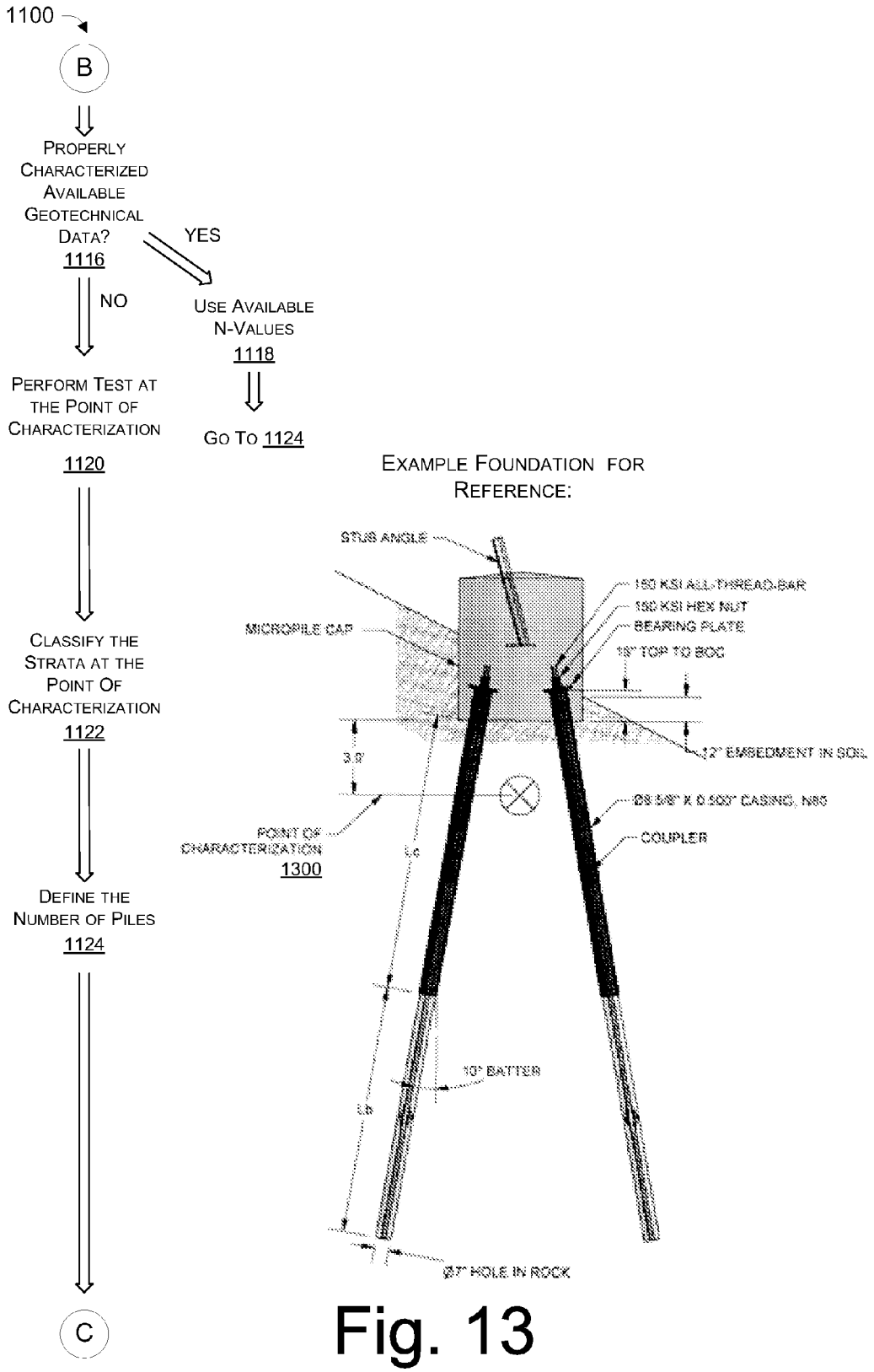

FIG. 13 continues the illustration of process 1100 and includes, at operation 1116, determining if properly-characterized geotechnical data for the first pile location (or for the site generally) is available. In some instances, this geotechnical data is described in terms of "N-values." If this properly-characterized data is available, then process 1100 proceed to use the available N-values at operation 1118 to determine aspects of the pile design, as described in detail below. In addition, the process proceeds to an operation 1124, also described below.

If, however, no available geotechnical data for the site exists, or if the available geotechnical data is determined to be improperly characterized for any reason, then process 1100 proceeds to operation 1120. Here, an operator may perform an in-situ (on-site) penetration test at a point of characterization 1300 to determine a geotechnical characteristic in the location 1106 associated with the first pile. This in-situ penetration test may comprise a Standard Penetration test (SPT) (as illustrated), a Cone Penetration Test (CPT), a penetration test that employs sound waves or any other similar or different test. Note that to perform this in-situ penetration test, the operator may employ rotating drill assembly 108, which has been properly set up to excavate first pile location 1106, as discussed above.

Point of characterization 1300, meanwhile, comprises a specified distance below ground. For instance, point of characterization 1300 may be, in some instances, more than one foot but less than six feet, or may comprise any other distance below ground. For instance, the operator may perform the in-situ penetration test at approximately three feet below ground measured from the bottom of the excavation.

After performing this penetration test at point of characterization 1300, the operator or another entity may classify, at operation 1122, the strata based on the results of the test. For instance, when the operator performs a Standard Penetration Test and determines a corresponding N-value (blows per foot) at the point of characterization, the operator may map this N-value to one of multiple defined soil conditions. For instance, the operator may determine whether this N-value corresponds to loose soil (e.g., $4<N<11$), medium dense soil (e.g., $12<N<39$), rock (e.g., $N>40$) or any other defined soil condition, possibly with reference to a decision matrix (an example of which is illustrated below in FIG. 16).

After classifying the strata at the point of characterization, the operator may define a number of piles to install at the pile group at operation 1124. For instance, after mapping an N-value associated with point of characterization 1300 to a defined soil condition for the tower site, the operator may consult the decision matrix that defines how many piles to install based on the soil condition, load conditions and possibly multiple other additional factors. For instance, the decision matrix may indicate that the operator should install eight piles for loose soil, six piles for medium dense soil and four piles for rocky conditions for a tower scheduled to be installed at the tower site. While a few example values have been listed, it is to be appreciated that these values are simply illustrative and that these values may vary based on the context of the application (e.g., load conditions, etc.).

Figure 14:
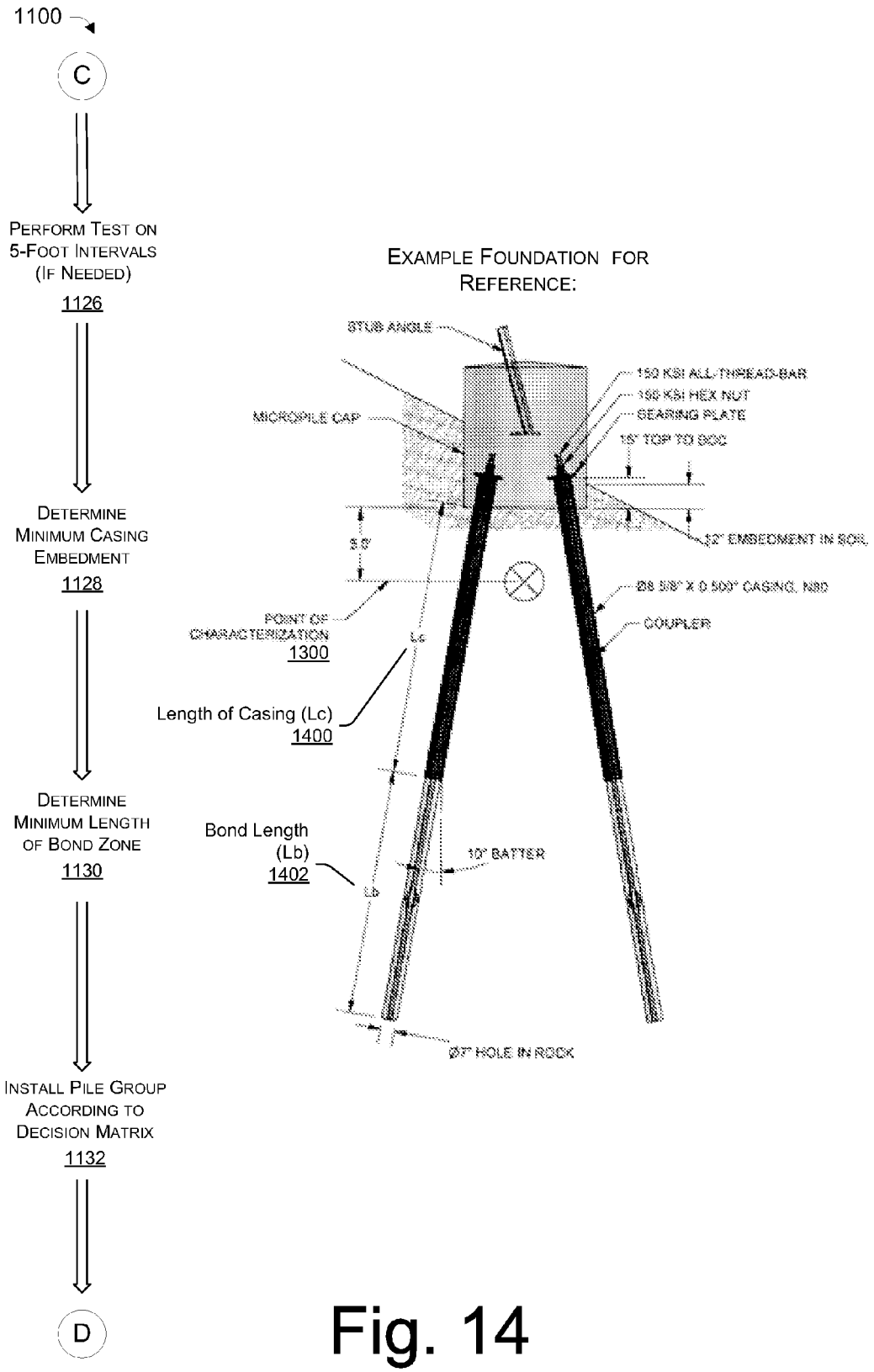

FIG. 14 continues the illustration of process 1100 and includes operation 1126, which represents performing an additional in-situ penetration test to determine a geotechnical characteristic at each of one or more intervals within first pile location 1106. In instances where properly-characterized geotechnical data is available (e.g., N-values), the operator may refrain from performing operation 1126 and may instead use the available data. Where properly-characterized data is not available however, the operator may perform the penetration tests at the specified intervals. For instance, the operator may perform these penetration tests at intervals of between two feet and ten feet. In one specific implementation, the operator performs the in-situ penetration test at five foot intervals until bedrock is reached or until a total depth of the pile (e.g., a total casing length plus a total bond length) is reached, as described below.

After determining a geotechnical characteristic (e.g., an N-value) at each interval, the operator may then use this information to determine a soil condition at each interval. With this information along with the previously-determined number of piles, the operator may consult the decision matrix mentioned above to determine a minimum casing embedment for the pile at operation 1128 based at least in part on determined soil conditions for the number of piles determined at operation 1124. The casing embedment may be defined, in some instances, as the length of permanent casing that extends beyond point of characterization 1300.

In the decision matrix, each type of soil condition at a tower site is associated with a minimum casing embedment for the determined number of piles. For instance, the decision matrix may state that for a four-pile group, the casing embedment length should be at least twelve feet for loose soil, ten feet for medium dense soil and nine feet for rock (see, for example, "Tower No. 29" in FIG. 16). For instance, envision that the operator has performed two in-situ penetration tests at five foot intervals below point of characterization 1300, and that each of these N-values indicates that the strata at each respective location comprises rock. Stated otherwise, these N-values indicate that the ten feet immediately below point of characterization 1300 comprises rock (assuming that no variation exists between the tested intervals). The minimum casing embedment in this instance would comprise nine feet and, as such, nine or more feet of casing would satisfy the decision matrix by meeting a minimum casing length requirement for one continuous soil condition.

In some instances, however, the upper strata may transition (e.g., between loose, medium dense, rock, etc.) before a minimum requirement is met for one continuous soil condition. If so, the decision matrix may require that the total length of the minimum casing embedment meet either or both of: (i) a minimum casing length for the weakest encountered soil condition in a combination of two or more soil of conditions, or (ii) a minimum casing length for a single soil condition.

For instance, returning to the four-pile-group example from above, envision that the operator determines (via interval testing) that the strata beneath point of characterization 1300 comprises eight feet of loose soil before transitioning to rock. As discussed above, the minimum required casing length for loose soil comprises twelve feet in this example, while the required casing length for rock comprises nine feet. Envision that the operator determines that rock continues past the eight feet of loose soil for four or more feet. Here, because loose soil comprises the weaker of the two soil conditions (loose soil and rock), the decision matrix determines that the minimum casing length for loose soil (twelve feet) has been satisfied by the twelve-foot combination of loose soil and rock.

In another instance, envision that the operator determines (via interval testing) that the strata beneath point of characterization 1300 comprises one foot of loose soil before transitioning to rock. Again, the minimum required casing length for loose soil comprises twelve feet, while the required casing length for rock comprises nine feet. Envision that the operator determines that rock continues past the one foot of loose soil for nine or more feet. Here, because the rock alone continues for at least the required nine feet, the decision matrix may determine that the rock satisfies the required minimum casing length. Here, the operator may install ten feet of casing, one foot of which will reside in loose soil and nine feet of which may reside in rock.

In addition, the operator may again consult the decision matrix to determine a minimum bond zone (i.e., a "minimum bond length") for the determined number of piles, at operation 1130. In some instances, the minimum bond length is defined to be the minimum required amount of bond length of a continuous bearing unit. Again, the determination of the minimum bond length may be made with reference to interval N-values and the soil conditions associated therewith.

In contrast to the minimum casing length, the bond zone must consist of the minimum required bond length of a single continuous soil condition in some instances. Therefore, if the strata transitions in the bond zone, the total length of the bond zone must be extended to include the minimum required length of one continuous unit.

In one example, the decision matrix may require, for a four-pile group, a minimum bond length of 23.5 feet for loose, sixteen feet for medium dense and ten feet for rock. For instance, envision that the operator determines from N-values associated the above-referenced interval testing, that the twenty feet of ground below the casing length comprises loose soil before transitioning to medium dense soil for another ten feet. Here, while the combination of the loose soil and the medium dense soil (thirty feet) would meet the requirement of loose soil (23.5 feet), the decision matrix is not satisfied because the strata does not comprise a continuous soil condition or unit. Instead, envision that the operator determines that the proceeding ten feet of strata comprises rock. Here, the operator may determine via the decision matrix that this ten feet of continuous rock satisfies the minimum bond zone. Therefore, the operator may install a pile having a bond length that extends forty feet past the end of the casing (twenty feet in soil+ten feet in medium dense soil+ten feet in rock).

After determining a number of piles to install in the group and determining a minimum casing embedment and bond length, the operator may install the group of piles at operation 1132. More specifically, the operator may install the defined number of piles, each having a length of casing 1400 and a bond length 1402 that are equal to or greater than their respective minimum values. In addition, the operator may utilize other parameters from the decision matrix (e.g., pile type, casing diameter, rebar diameter, etc.) to install this pile group at the tower site.

Figure 15:
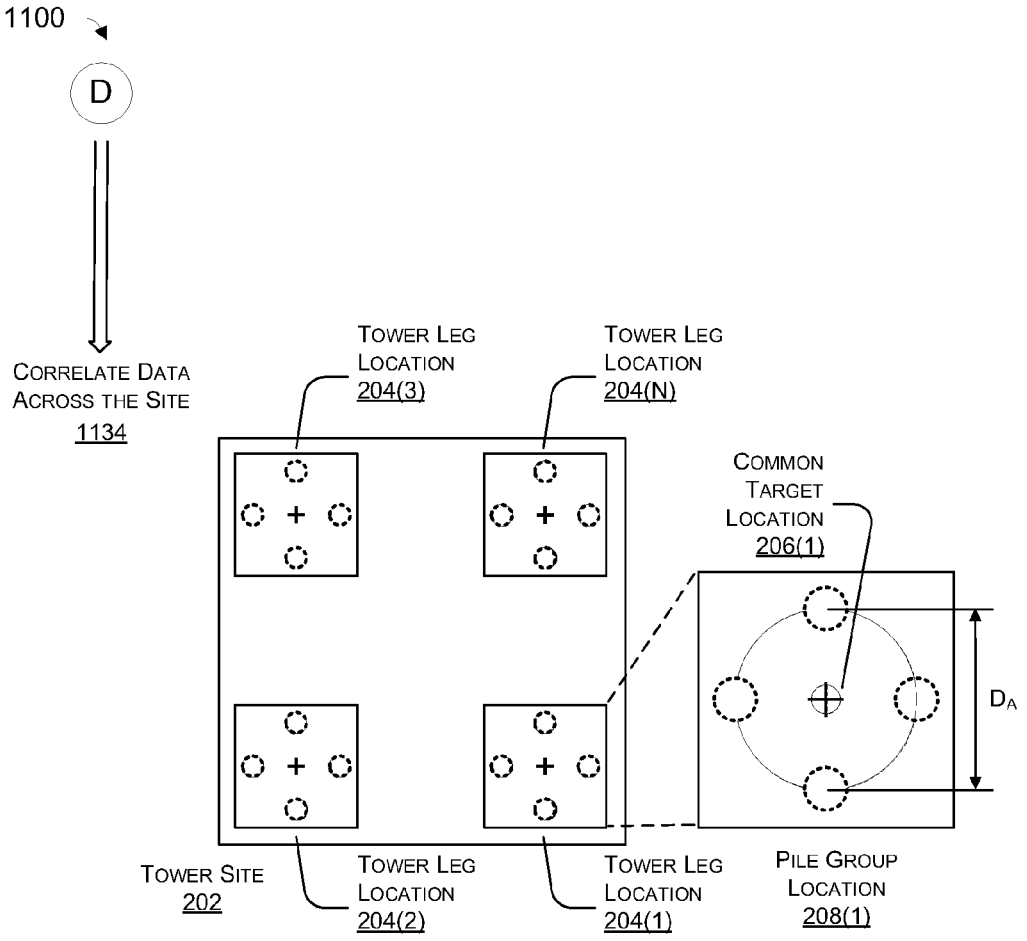

FIG. 15 concludes the illustration of process 1100 and includes, at operation 1134, correlating the determined data across the tower site or the entire work site. That is, the operator of the site may install, at each tower leg location and possibly at other tower leg locations for the tower site, the determined number of piles having the determined minimum casing embedment and bond length, so long as the geotechnical characteristics of these locations do not differ by more than a threshold amount from the first pile location.

If the geotechnical characteristics do differ by more than the threshold amount, then operations 1120 through 1132 may be repeated to determine a new quantity of piles, minimum casing embedment and/or bond length for these other piles. In other instances, the operator may repeat operations 1102 through 1132 for each pile, for each pile group, for each tower leg location or for each tower site, depending upon work site characteristics and other factors.

FIG. 16 illustrates an example foundation pile schedule 1600 for use with the example process 1100 described immediately above. While this schedule includes several example design parameters, it is to be appreciated that these parameters are merely illustrative and that the parameters may change based on work site factors, design considerations and the like.

Foundation pile schedule 1600 first illustrates details 1602 regarding a series of towers that are scheduled to be coupled to respective foundations. Foundation pile schedule 1600 also includes details 1604 regarding these foundations and a decision matrix for architecting the details of the foundation designs. Foundation details include, for instance, a projection of the pile group, various elevations of the pile group, an array diameter and batter angle of the pile group, as well as casing and rebar diameters. In addition, the details include a number of piles, a minimum casing embedment, a minimum bond length and a micropile type. Each of these latter details may be dependent upon tower details 1602, other pile design parameters and soil conditions at the point of characterization and below this point as described with reference to process 1100.

Example Structural Caps and Associated Process

Figure 17:
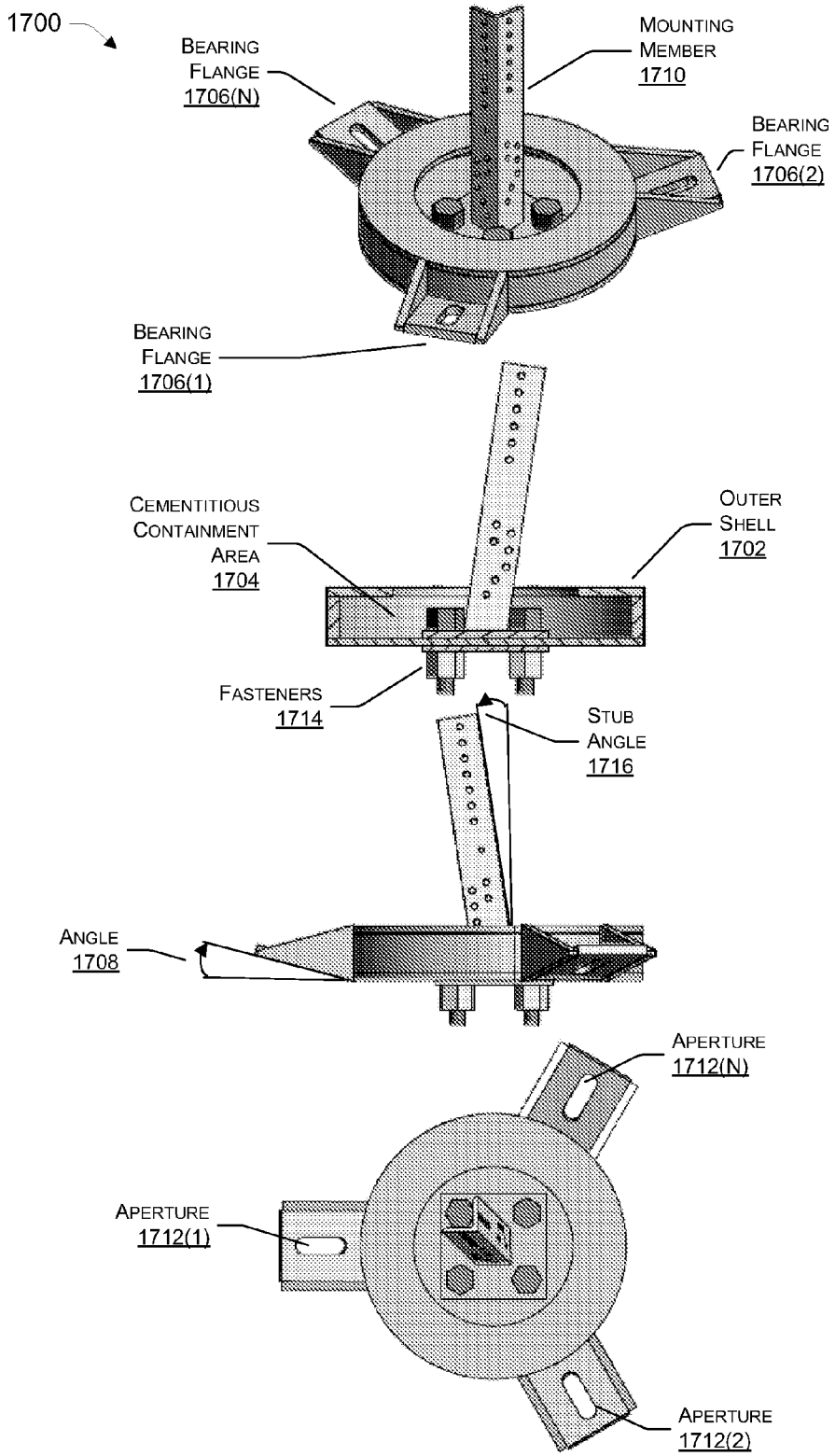
FIG. 17 illustrates an example structural cap that may be used to couple multiple piles with one another. As illustrated, the cap may include both a shell and a cementitious containment area that may be filled with a cementitious material. In addition, this cap may include a bearing flange having an angle designed to match a batter angle of the piles.

FIG. 17 illustrates an example structural cap 1700 that may be used to couple multiple piles or other structural members with one another and to a portion of a structure, such as a leg of a tower. As illustrated, structural cap 1700 may include both an outer shell 1702 and a cementitious containment area 1704 defined by outer shell 1702. In addition, this cap may include one or more bearing flanges 1706(1), 1706(2), . . . , 1706(N) each having an angle 1708 designed to match a batter angle of the piles to which the cap couples. Finally, structural cap 1700 may include a mounting member 1710 to attach to a portion of the structure that the pile foundation supports. For instance, mounting member 1710 may attach to a tower leg of a lattice tower.

As illustrated, outer shell 1702 may comprise a substantially circular base member and a substantially ring-shaped top member that is formed of metal (e.g., steel), plastic, or any other suitable material. In addition, the shell may comprise a containment wall attached perpendicularly on one side of the wall to a perimeter of the substantially circular base member and perpendicularly on an opposite side of the wall to the substantially ring-shaped top member.

As such, outer shell 1702 comprises a void within the shell that defines cementitious containment area 1704 configured to receive a cementitious mixture, such as cement or the like. In addition, bearing flanges 1706(1)-(N) may be arranged on along an outer perimeter of outer shell 1702. In some instances, structural cap 1700 may be designed to include an equal number of bearing flanges as a number of piles to which the cap is designed to couple with. For instance, a cap that is designed to secure a four-pile group of radial array battered micropiles may include four bearing flanges.

In these instances, each of bearing flanges 1706(1)-(N) may be further designed to include angle 1708 that matches a predetermined batter angle of the radial array of piles. As such, when a cap couples with the radial array of piles, each micropile may mate perpendicularly with a respective bearing flange. As such, the micropile may mate in a flush manner with the respective bearing flange, creating a secure interface between the pile and structural cap 1700.

In order to securely couple with each pile or other structural member, each of bearing flanges of structural cap 1700 may include a respective aperture 1712(1), 1712(2), . . . , 1712(N). In some instances, these apertures comprise an oval or circular aperture that receives a respective portion of a pile, such as a threaded bar of the like. After structural cap 1700 is placed on each pile of the radial array of piles, the cap may be secured in place via fasteners that couple to the threaded bar and reside on top of a respective bearing flange.

Furthermore, in some instances, apertures 1712(1)-(N) are designed to create a degree of tolerance between the respective bearing flange and the threaded bar of the battered micropile that the bearing flange receives. As such, an installer of structural cap 1700 may use this tolerance to ensure that each bearing flange of structural cap 1700 properly mates with a respective battered micropile.

As illustrated, mounting member 1710 attaches to a bottom center of outer shell 1702. More specifically, mounting member 1710 adjustably attaches via fasteners 1714 to the bottom member of the shell and protrudes out of the cementitious containment area 1704 to make a connection with the tower leg at a predetermined stub angle 1716 of the tower leg. Before connecting in this manner, however, mounting member 1710 may be adjusted into a position within the bottom center of cementitious containment area 1704 and securely fastened in place via fasteners 1714.

As the reader will appreciate, the adjustability of the mounting member 1710 allows the installer of cap 1700 to adjust mounting member 1710 to more precisely fit a location of the tower leg or other structural member to which cap 1700 couples. In addition, because mounting member 1710 attached to cap 1700 via fasteners 1714, this member is securely attached before the reception of the cementitious mixture, described immediately below.

After coupling structural cap 1700 to a group of piles or other structural members and after positioning mounting member 1710, an installer of the cap may proceed to fill cementitious containment area 1704 with a cementitious mixture, such as concrete or the like. After curing for a certain amount of time, the cementitious mixture functions to stiffen outer shell 1702 and support mounting member 1710.

As such, structural cap 1700 provides strength found in traditional concrete caps, while being of a lighter weight and requiring a lesser volume of materials than compared with traditional concrete caps. Hence, structural cap 1700 is more portable into a difficult-access work sites, such as work site 100. In addition, because structural cap 1700 requires far less cementitious mixture than traditional concrete caps, a cure time for installation of cap 1700 is much less, as is the required labor to install cap 1700. This smaller cure time and lesser labor enables the operator of work site 100 to more quickly and cost-effectively complete the series of foundations for the site. In addition to enabling quick and cost-effective installation, structural caps also enable for better quality control, as structural cap 1700 may be manufactured in a controlled environment (i.e., in a manufacturing facility) rather than in the field, as is common for concrete caps. In other words, the structural cap as described in FIG. 17 may be fabricated in a manufacturing facility that ensures quality control of the structural cap before providing the cap to the work site, such as difficult-access work site 100.

Figure 18:
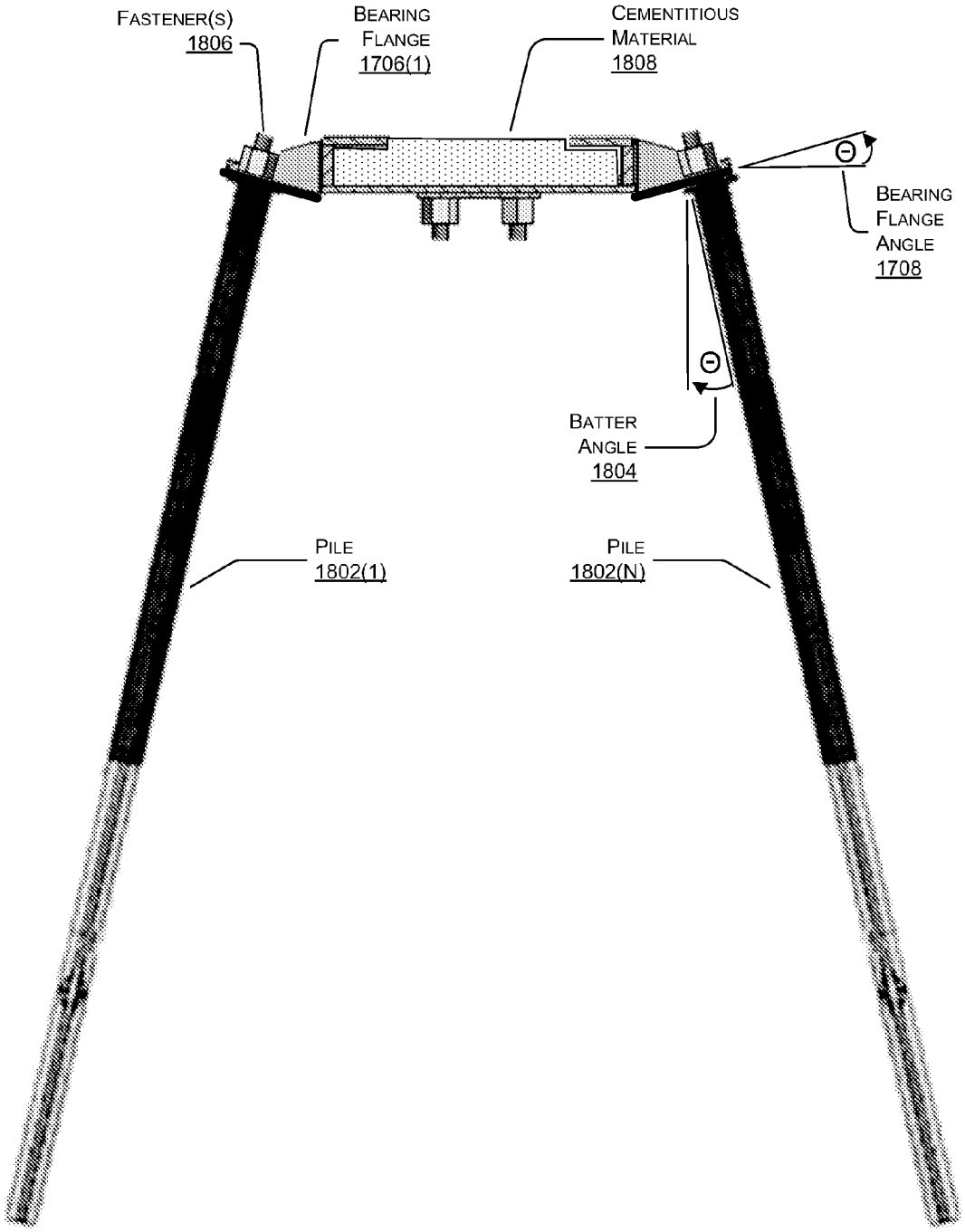
FIG. 18 illustrates a structural cap with angled bearing flanges coupling multiple piles with one another. As shown, the cementitious containment area of the cap has been filled with a cementitious material after securing the cap to the piles.

FIG. 18 illustrates structural cap 1700 with angled bearing flanges 1706(1)-(N) after the cap has been fastened to a radial array of micropiles 1802(1), . . . , 1802(N) each installed at a batter angle 1804. As shown, bearing flanges 1706(1)-(N) have been designed with an angle 1708 that matches batter angle 1804. In addition, each of bearing flanges 1706(1)-(N) has been coupled with a respective micropile 1802(1)-(N) via one or more fasteners 1806. As shown, due to the angle of the bearing flanges, each flange and respective micropile mate in a substantially perpendicular manner.

Finally, FIG. 18 illustrates that cementitious containment area 1704 of the cap has been filled with a cementitious material 1808 after securing the cap to the piles and after adjusting and fastening mounting member (not shown). After a sufficient cure time, an operator of work site 100 or another work site may couple a tower leg or other structural element to the completed foundation via the mounting member.

Figure 19:
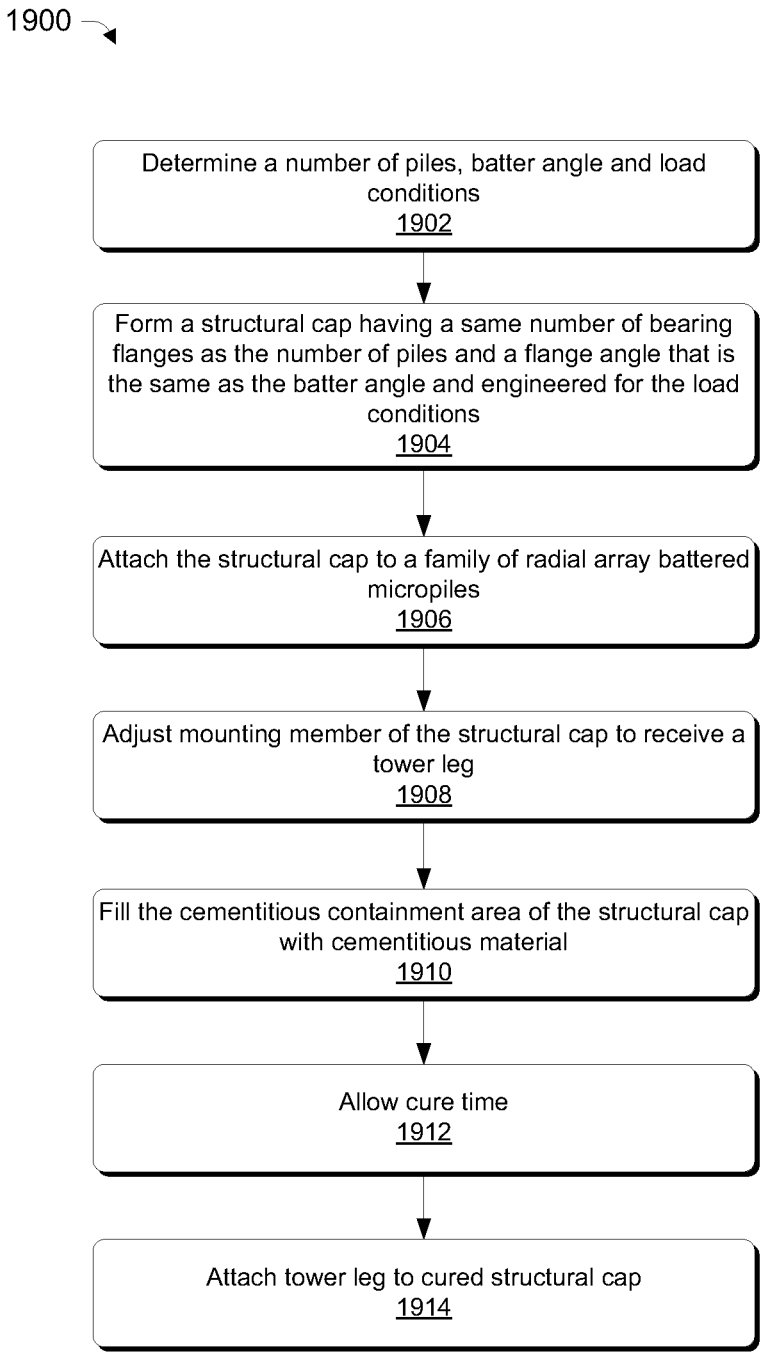
FIG. 19 is a flow diagram of an example process for designing, building and installing a structural cap to multiple piles. In some instances, this process designs bearing flanges of the cap to have an angle that matches a batter angle of the piles coupled together by the cap.

FIG. 19 is a flow diagram of an example process 1900 for designing, building and installing a structural cap to multiple piles or other structural elements, such as a group of a radial array of battered micropiles. In some instances, this process designs bearing flanges of the cap to have an angle that matches a batter angle of the piles coupled together by the cap, as illustrated and described above. In addition, because this cap may comprise both a metal outer shell and may be configured to receive a cementitious mixture, this structural cap may be known as a "composite cap."

Process 1900 includes determining, at operation 1902, characteristics of a group of piles or other members to which a structural cap will attach. For instance, operation 1902 may determine a number of piles, a batter angle of the piles, load conditions associated with the pile foundation and the like.

Next, operation 1904 represents forming a structural cap to comply with the determined characteristics. For instance, the cap may be designed to include a same number of bearing flanges as a number of piles in the foundation and a bearing flange angle that matches the determined batter angle. In addition, the dimensions of the cap may be engineered and designed to the meet the required load conditions.

At operation 1906, the formed structural cap is attached to the group of piles or other structural members, such as to a group of radial array battered micropiles, as described above. Operation 1908, meanwhile, represents adjusting a mounting member of the structural cap to receive a tower leg or other structural element. Next, operation 1910 represents filling the void of the cementitious mixture containment area with a cementitious mixture, such as concrete or the like. After allowing the mixture to cure at operation 1912, the operator may install the tower leg to the cured structural cap 1914.

Conclusion

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

We claim:

1. A method for installing a pile group at a site, the method comprising:

at a time of installation of a first pile of the pile group at the site, positioning a drill assembly to the first pile of the pile group at the site;

performing, using the drill assembly, an in-situ penetration test to determine a geotechnical characteristic of a stratum at a point of characterization in the first pile location of the pile group, wherein the point of characterization comprises a distance in the ground below a pile cap excavation at the site;

at least partly subsequent to the performing of the in-situ penetration test, determining a quantity of piles to include in the pile group based on the determined geotechnical characteristic of the stratum at the point of characterization in the first pile location, wherein the determining of the quantity of piles at the time of installation of the first pile of the pile group at the site comprises mapping, via a predefined mapping, the determined geotechnical characteristic of the stratum to one of multiple defined soil conditions, and wherein the determined quantity of piles is based at least in part on the one defined soil condition; and initiating, using the drill assembly, installation of the determined quantity of piles.

2. The method as recited in claim 1, wherein the in-situ penetration tests comprise one or more of a Standard Penetration Test (SPT) or a Cone Penetration Test (CPT).

3. The method as recited in claim 1, wherein the piles comprise micropiles, and wherein the initiating of the installation comprises initiating installation of a radial array of micropiles.

4. The method as recited in claim 1, wherein the determined quantity of piles is used as a quantity for each additional pile group at the site.

5. The method as recited in claim 1, further comprising repeating the performing of the in-situ penetration test, the determining of a quantity of piles and the initiating of the installation for each additional pile group at the site.

6. The method as recited in claim 1, wherein the site comprises one of multiple sites, and wherein the determined quantity of piles is used as a quantity for each additional pile group for at least one other site.

7. The method as recited in claim 1, wherein the distance in the ground below the pile cap excavation at the site is between one foot and six feet.

8. The method as recited in claim 1, wherein the multiple defined soil conditions comprise loose, medium dense and rock.

9. The method as recited in claim 1, further comprising:

performing an in-situ penetration test to determine a geotechnical characteristic at each of one or more intervals past the point of characterization in the first pile location; and determining a minimum length of casing embedment and a minimum bond length for the determined quantity of piles based on a determined geotechnical characteristic at each of the one or more intervals.

10. The method as recited in claim 9, wherein the pile group comprises a first of multiple pile groups at the site, and further comprising:

during the installation of a pile at a pile location at the first pile group or another pile group, determining whether a geotechnical characteristic of a stratum at the point of characterization in the pile location differs by more than a predefined threshold amount from the determined geotechnical characteristic of the stratum of the first pile location; and at least partly in response to determining that the geotechnical characteristic of the stratum at the point of characterization in the pile location does not differ by more than the predefined threshold amount, continuing to install the determined quantity of piles each having the determined minimum casing embedment and minimum bond length at each pile group location of the site; and at least partly in response to determining that the geotechnical characteristic of the stratum at the point of characterization in the pile location does differ by more than the predefined threshold amount, performing a new in-situ penetration test at the point of characterization in the pile location and a new in-situ penetration test at each of one or more intervals past the point of characterization.

11. The method as recited in claim 9, wherein each of the intervals past the point of characterization at the first pile location is between two feet and ten feet past the point of characterization.

12. The method as recited in claim 11, wherein the performing of the in-situ penetration test at the one or more intervals continues until bedrock is encountered or until a total depth of the first pile location is reached.

13. The method as recited in claim 1, further comprising:

before the performing of the in-situ penetration test at the point of characterization in the first pile location, determining that: (i) a deficiency of geotechnical data available for the site or for the first pile location exists, or (ii) previously-compiled geotechnical data differs from the geotechnical characteristic of the stratum encountered at the point of characterization in the first pile location by more than a predefined threshold amount, and wherein the performing of the in-situ penetration test at the point of characterization is based on the determining that the deficiency exists or that the previously-compiled geotechnical data differs from the geotechnical characteristic of the stratum encountered at the point of characterization in the first pile location by more than the predefined threshold amount.

14. A method for installing a group of structural members at a site, the method comprising:

at a time of installation of a first structural member of the group of structural members at the site, performing an in-situ penetration test at a point of characterization in a first location for the first structural member of the group of structural members to determine a geotechnical characteristic of a stratum at the point of characterization, wherein the point of characterization comprises a distance in the ground below a pile cap excavation at the site;

at least partly subsequent to the performing of the in-situ penetration test, determining a quantity of structural members to include in the group of structural members based on the determined geotechnical characteristic at the point of characterization, wherein the determining of the quantity of structural members at the time of installation of the first structural member of the group of structural members at the site comprises mapping, via a foundation schedule, the determined geotechnical characteristic at the point of characterization to one of multiple defined soil conditions, and wherein the determined quantity of structural members is based at least in part on the one defined soil condition;

subsequent to the determining of the quantity of structural members, initiating installation of the determined quantity of structural members;

performing an in-situ penetration test at each of one or more intervals past the point of characterization to determine a geotechnical characteristic at each of the one or more intervals; and determining a length for the determined quantity of structural members based on a determined characteristic at each of the one or more intervals.

15. The method as recited in claim 14, wherein the in-situ penetration tests comprise one or more of a standard penetration test (SPT) or a cone penetration test (CPT).

16. The method as recited in claim 14, wherein the structural members comprise rock anchors or piles.

17. The method as recited in claim 14, wherein the structural members comprise micropiles, and wherein the initiating of the installation comprises initiating installation of a radial array of micropiles.

18. The method as recited in claim 14, wherein the structural members collectively form at least a portion of a foundation for a tower.

19. The method as recited in claim 14, wherein the structural members collectively form at least a portion of a first foundation of multiple foundations to receive a first leg of multiple legs of a lattice tower.

20. The method as recited in claim 14, wherein the determining of the length for the determined quantity of structural members comprises determining a casing embedment length of the structural members based on the determined characteristic at each of the one or more intervals.

21. The method as recited in claim 14, wherein the determining of the length for the quantity of structural members comprises determining a bond length of the structural members based on the determined characteristic at each of the one or more intervals.

22. The method as recited in claim 14, wherein the determined quantity of structural members is used as a quantity for each additional group of structural members at the site.

23. The method as recited in claim 14, further comprising repeating the performing of the in-situ penetration test to determine a geotechnical characteristic, the determining of a quantity of structural members, the initiating of the installation, the performing of the in-situ penetration test at each of one or more intervals past the point of characterization and the determining of a length for the determined quantity of structural members for each additional group of structural members at the site.

24. The method as recited in claim 14, wherein the site comprises one of multiple sites, and wherein the determined quantity of structural members is used as a quantity for each additional group of structural members for at least one other site.

25. The method as recited in claim 14, wherein the distance in the ground below the pile cap excavation at the site is between one foot and six feet.

26. The method as recited in claim 14, wherein the multiple defined soil conditions comprise loose, medium dense and rock.

27. The method as recited in claim 14, wherein each of the intervals past the point of characterization is between two feet and ten feet past the point of characterization.

28. The method as recited in claim 14, wherein the performing of the in-situ penetration test at the one or more intervals continues until bedrock is encountered or until a total depth of the group of structural members is reached.

29. The method as recited in claim 14, further comprising: before the performing of the in-situ penetration test at the point of characterization, determining that: (i) a deficiency of geotechnical data available for the site or for the group of structural members exists, or (ii) previously-compiled geotechnical data differs from the geotechnical characteristic of the stratum encountered at the point of characterization in the first location for the first structural member by more than a predefined threshold amount, and wherein the performing of the in-situ penetration test at the point of characterization is based on the determining that the deficiency exists or that the previously-compiled geotechnical data differs from the geotechnical characteristic of the stratum encountered at the point of characterization in the first location for the first structural member by more than the predefined threshold amount.

* * * * *